US008177525B2

(12) United States Patent
Takahashi et al.

(10) Patent No.: US 8,177,525 B2
(45) Date of Patent: May 15, 2012

(54) EXPANDER-INTEGRATED COMPRESSOR

(75) Inventors: Yasufumi Takahashi, Osaka (JP); Hiroshi Hasegawa, Osaka (JP); Takumi Hikichi, Osaka (JP); Takeshi Ogata, Osaka (JP)

(73) Assignee: Panasonic Corporation, Osaka (JP)

( * ) Notice: Subject to any disclaimer, the term of this patent is extended or adjusted under 35 U.S.C. 154(b) by 430 days.

(21) Appl. No.: 12/522,762

(22) PCT Filed: Nov. 21, 2007

(86) PCT No.: PCT/JP2007/072542

§ 371 (c)(1),
(2), (4) Date: Jul. 10, 2009

(87) PCT Pub. No.: WO2008/087795

PCT Pub. Date: Jul. 24, 2008

(65) Prior Publication Data

US 2010/0003147 A1 Jan. 7, 2010

(30) Foreign Application Priority Data

Jan. 15, 2007 (JP) ..... 2007-005511

(51) Int. Cl.
*F04B 39/06* (2006.01)
*F04B 39/02* (2006.01)

(52) U.S. Cl. ..... 417/373; 417/410.5; 418/94

(58) Field of Classification Search ..... 417/410.5, 417/373, 374; 418/3, 55.6, 83, 85, 88, 91, 418/92, 94; 184/6.11, 6.21, 6.22; 62/402, 62/403, 468

See application file for complete search history.

(56) References Cited

U.S. PATENT DOCUMENTS 3,848,702 A * 11/1974 Bergman ..... 184/6.3
4,846,640 A * 7/1989 Nishida et al. ..... 418/55.6
4,865,530 A * 9/1989 Nishida et al. ..... 418/55.6
5,214,932 A * 6/1993 Abdelmalek ..... 62/238.4

(Continued)

FOREIGN PATENT DOCUMENTS

EP 1 918 510 5/2008

(Continued)

OTHER PUBLICATIONS

Extended European Search Report issued on corresponding European Patent Application No. 07832272.4, dated May 11, 2010, 4 pages.

*Primary Examiner* — Devon Kramer
*Assistant Examiner* — Christopher Maxey
(74) *Attorney, Agent, or Firm* — Hamre, Schumann, Mueller & Larson, P.C.

(57) ABSTRACT

An expander-integrated compressor 200A includes a closed casing 1, a compression mechanism 2, an expansion mechanism 3, a shaft 5, an oil pump 6, and a heat insulating structure 30A. The oil pump 6 is disposed between the compression mechanism 1 and the expansion mechanism 3, and draws, via an oil suction port 62*q*, an oil held in an oil reservoir 25 to supply it to the compression mechanism 2. The heat insulating structure 30A is disposed between the oil pump 6 and the expansion mechanism 3, and limits a flow of the oil between an upper tank 25*a*, in which the oil suction port 62*q* is located, and a lower tank 25*b*, in which the expansion mechanism 3 is located, so as to suppress heat transfer from the oil filling the upper tank 25*a* to the oil filling the lower tank 25*b*.

34 Claims, 27 Drawing Sheets

U.S. PATENT DOCUMENTS

| | | | | |
|---|---|---|---|---|
| 5,263,822 | A * | 11/1993 | Fujio | 418/55.4 |
| 5,358,392 | A * | 10/1994 | Ukai | 418/55.6 |
| 5,520,526 | A * | 5/1996 | Fujio | 418/55.4 |
| 5,616,019 | A | 4/1997 | Hattori et al. | |
| 5,660,539 | A * | 8/1997 | Matsunaga et al. | 418/55.6 |
| 5,775,883 | A * | 7/1998 | Hattori et al. | 417/310 |
| 6,098,753 | A * | 8/2000 | Lamarre et al. | 184/6.11 |
| 7,628,592 | B2 * | 12/2009 | Okamoto et al. | 418/3 |
| 7,717,688 | B2 * | 5/2010 | Yoo et al. | 418/88 |
| 7,771,180 | B2 * | 8/2010 | Cho et al. | 418/55.6 |
| 7,896,627 | B2 * | 3/2011 | Okamoto et al. | 418/13 |
| 8,033,135 | B2 * | 10/2011 | Okaichi et al. | 62/468 |
| 8,087,260 | B2 * | 1/2012 | Ogata et al. | 62/401 |
| 2006/0204378 | A1 * | 9/2006 | Anderson | 417/410.5 |
| 2008/0232992 | A1 | 9/2008 | Okamoto et al. | |
| 2009/0007590 | A1 * | 1/2009 | Sakitani et al. | 62/513 |
| 2009/0139262 | A1 * | 6/2009 | Takahashi et al. | 62/468 |
| 2009/0282845 | A1 * | 11/2009 | Hasegawa et al. | 62/87 |
| 2010/0089092 | A1 * | 4/2010 | Hasegawa et al. | 62/498 |
| 2010/0107680 | A1 * | 5/2010 | Ogata et al. | 62/468 |
| 2010/0132398 | A1 * | 6/2010 | Takahashi et al. | 62/468 |
| 2010/0162750 | A1 * | 7/2010 | Okaichi et al. | 62/498 |
| 2010/0186439 | A1 * | 7/2010 | Ogata et al. | 62/402 |
| 2010/0202909 | A1 * | 8/2010 | Shiotani et al. | 418/3 |
| 2010/0254844 | A1 * | 10/2010 | Oyagi et al. | 418/102 |
| 2010/0263404 | A1 * | 10/2010 | Shiotani et al. | 62/468 |
| 2010/0269536 | A1 * | 10/2010 | Wada et al. | 62/402 |
| 2010/0275638 | A1 * | 11/2010 | Hasegawa et al. | 62/402 |
| 2011/0138831 | A1 * | 6/2011 | Ogata et al. | 62/193 |
| 2011/0302954 | A1 * | 12/2011 | Okaichi et al. | 62/468 |

FOREIGN PATENT DOCUMENTS

| | | | | |
|---|---|---|---|---|
| EP | 2 020 483 | A1 | | 2/2009 |
| JP | 08-028461 | | | 1/1996 |
| JP | 08086289 | A | * | 4/1996 |
| JP | 10266980 | A | * | 10/1998 |
| JP | 2003-139059 | A | | 5/2003 |
| JP | 2005-299632 | A | | 10/2005 |
| JP | 2006132377 | A | * | 5/2006 |
| JP | 2007315227 | A | * | 12/2007 |
| WO | 2007/000854 | | | 1/2007 |
| WO | WO 2007/132649 | A1 | | 11/2007 |

* cited by examiner

EXPANDER-INTEGRATED COMPRESSOR

TECHNICAL FIELD

The present invention relates to an expander-integrated compressor including a compression mechanism for compressing fluid and an expansion mechanism for expanding fluid.

BACKGROUND ART

Conventionally, expander-integrated compressors are known as a fluid machine having a compression mechanism and an expansion mechanism. FIG. 29 shows a vertical cross-sectional view of an expander-integrated compressor described in JP 2005-299632 A.

An expander-integrated compressor 103 includes a closed casing 120, a compression mechanism 121, a motor 122, and an expansion mechanism 123. The motor 122, the compression mechanism 121, and the expansion mechanism 123 are coupled to each other with a shaft 124. The expansion mechanism 123 recovers mechanical power from a working fluid (for example, a refrigerant) that is expanding, and supplies the recovered mechanical power to the shaft 124. Thereby, the power consumption of the motor 122 driving the compression mechanism 121 is reduced, improving the coefficient of performance of a system using the expander-integrated compressor 103.

A bottom portion 125 of the closed casing 120 is utilized as an oil reservoir. In order to pump up the oil held in the bottom portion 125 to an upper part of the closed casing 120, an oil pump 126 is provided at a lower end of the shaft 124. The oil pumped up by the oil pump 126 is supplied to the compression mechanism 121 and the expansion mechanism 123 via an oil supply passage 127 formed in the shaft 124. Thereby, lubrication and sealing can be ensured for the sliding parts of the compression mechanism 121 and those of the expansion mechanism 123.

An oil return passage 128 is provided at an upper part of the expansion mechanism 123. One end of the oil return passage 128 is connected to the oil supply passage 127 in the shaft 124, while the other end opens downward below the expansion mechanism 123. Generally, the oil is supplied excessively in order to ensure the reliability of the expansion mechanism 123. The excess oil is discharged below the expansion mechanism 123 via the oil return passage 128.

The amount of the oil mixed in the working fluid in the compression mechanism 121 usually is different from that in the expansion mechanism 123. Accordingly, in the case where the compression mechanism 121 and the expansion mechanism 123 are accommodated in separate closed casings, a means for adjusting the oil amounts between the two closed casings is necessary in order to prevent excess and deficiency of the oil. In contrast, the expander-integrated compressor 103 shown in FIG. 29 substantially is free from the problem of excess and deficiency of the oil because the compression mechanism 121 and the expansion mechanism 123 are accommodated in the same closed casing 120.

In the above-mentioned expander-integrated compressor 103, the oil pumped up from the bottom portion 125 is heated by the compression mechanism 121 because the oil passes through the compression mechanism 121 having a high temperature. The oil heated by the compression mechanism 121 is heated further by the motor 122, and reaches the expansion mechanism 123. The oil having reached the expansion mechanism 123 is cooled in the expansion mechanism 123 having a low temperature, and is discharged below the expansion mechanism 123 via the oil return passage 128. The oil discharged from the expansion mechanism 123 is heated when passing along a side face of the motor 122, and is heated further when passing along a side face of the compression mechanism 121. The oil then returns to the bottom portion 125 of the closed casing 120.

As described above, the oil circulation between the compression mechanism and the expansion mechanism causes heat transfer from the compression mechanism to the expansion mechanism via the oil. Such heat transfer lowers the temperature of the working fluid discharged from the compression mechanism, and raises the temperature of the working fluid discharged from the expansion mechanism, hindering improvement of the coefficient of performance of the system using the expander-integrated compressor.

DISCLOSURE OF INVENTION

The present invention has been accomplished in view of the foregoing, and is intended to provide an expander-integrated compressor in which heat transfer from the compression mechanism to the expansion mechanism is suppressed.

In order to achieve this object, the inventors disclose, in International Application PCT/JP2007/058871 (filing date Apr. 24, 2007, priority date May 17, 2006) filed prior to the present application, an expander-integrated compressor including: a closed casing having a bottom portion utilized as an oil reservoir; a compression mechanism disposed in the closed casing so as to be located either higher or lower than an oil level of oil held in the oil reservoir; an expansion mechanism disposed in the closed casing so that its positional relationship to the oil level is vertically opposite to that of the compression mechanism; a shaft for coupling the compression mechanism and the expansion mechanism to each other; and an oil pump, disposed between the compression mechanism and the expansion mechanism, for supplying the oil filling a space surrounding the compression mechanism or a space surrounding the expansion mechanism to the compression mechanism or the expansion mechanism that is located higher than the oil level.

In this expander-integrated compressor, the vertical positional relationship between the compression mechanism and the expansion mechanism is not limited. However, when the compression mechanism is disposed higher than the oil level and the expansion mechanism is disposed lower than the oil level, a greater effect of preventing the heat transfer via the oil can be attained. And it has been found that an additional improvement discussed below can enhance further the effect of preventing the heat transfer.

Thus, the present invention provides an expander-integrated compressor including:

a closed casing having a bottom portion utilized as an oil reservoir, and an internal space to be filled with a working fluid compressed to a high pressure;

a compression mechanism, disposed at an upper part of the closed casing, for compressing the working fluid and discharging the working fluid to the internal space of the closed casing;

an expansion mechanism, disposed at a lower part of the closed casing in such a manner that a space surrounding the expansion mechanism is filled with an oil held in the oil reservoir, for recovering mechanical power from the expanding working fluid;

a shaft coupling the compression mechanism and the expansion mechanism so as to transfer the mechanical power recovered by the expansion mechanism to the compression mechanism;

an oil pump, disposed between the compression mechanism and the expansion mechanism in an axial direction of the shaft, for drawing the oil held in the oil reservoir via an oil suction port and supplying the oil to the compression mechanism; and a heat insulating structure, disposed between the oil pump and the expansion mechanism in the axial direction of the shaft, for suppressing heat transfer from an upper tank, in which the oil suction port is located, to a lower tank, in which the expansion mechanism is located, by limiting a flow of the oil between the upper tank and the lower tank.

The expander-integrated compressor of the present invention is of the so-called high pressure shell type, in which the closed casing is filled with a high temperature, high pressure working fluid. The compression mechanism, which has a high temperature during operation, is disposed at the upper part of the closed casing. The expansion mechanism, which has a low temperature during operation, is disposed at the lower part of the closed casing. The oil for lubricating the compression mechanism and the expansion mechanism is held in the bottom portion of the closed casing. The space (the oil reservoir) in which the oil is held is divided into the upper tank and the lower tank by the heat insulating structure. The heat insulating structure limits the flow of the oil between the upper tank and the lower tank, and suppresses the oil from being stirred in the lower tank.

Since the oil suction port of the oil pump is located in the upper tank, the oil pump draws primarily the high temperature oil in the upper tank. The oil drawn by the oil pump is supplied to the compression mechanism located at the upper part without passing through the expansion mechanism located at the lower part, and then returns to the upper tank. On the other hand, the low temperature oil in the lower tank is supplied to the expansion mechanism. The oil having lubricated the expansion mechanism returns directly to the lower tank. By disposing the oil pump between the compression mechanism and the expansion mechanism and using the oil pump to supply the oil to the compression mechanism in this way, it is possible to keep the expansion mechanism away from the circulation route of the oil that lubricates the compression mechanism. In other words, it is possible to prevent the expansion mechanism from being located on the circulation route of the oil that lubricates the compression mechanism. Thereby, the heat transfer from the compression mechanism to the expansion mechanism via the oil is suppressed.

Furthermore, by using the heat insulating structure in order to suppress the oil from flowing between the upper tank and the lower tank and to suppress the oil from being stirred in the lower tank, it is possible to maintain reliably the state in which the high temperature oil is held in the upper tank and the low temperature oil is held in the lower tank. In this way, the oil pump and the heat insulating structure work in combination to suppress the heat transfer from the compression mechanism to the expansion mechanism via the oil. The heat insulating structure limits the flow of the oil between the upper tank and the lower tank, but does not forbid it completely. Thus, the amount of the oil in the upper tank is not out of balance with that in the lower tank.

BEST MODE FOR CARRYING OUT THE INVENTION

Figure 1:
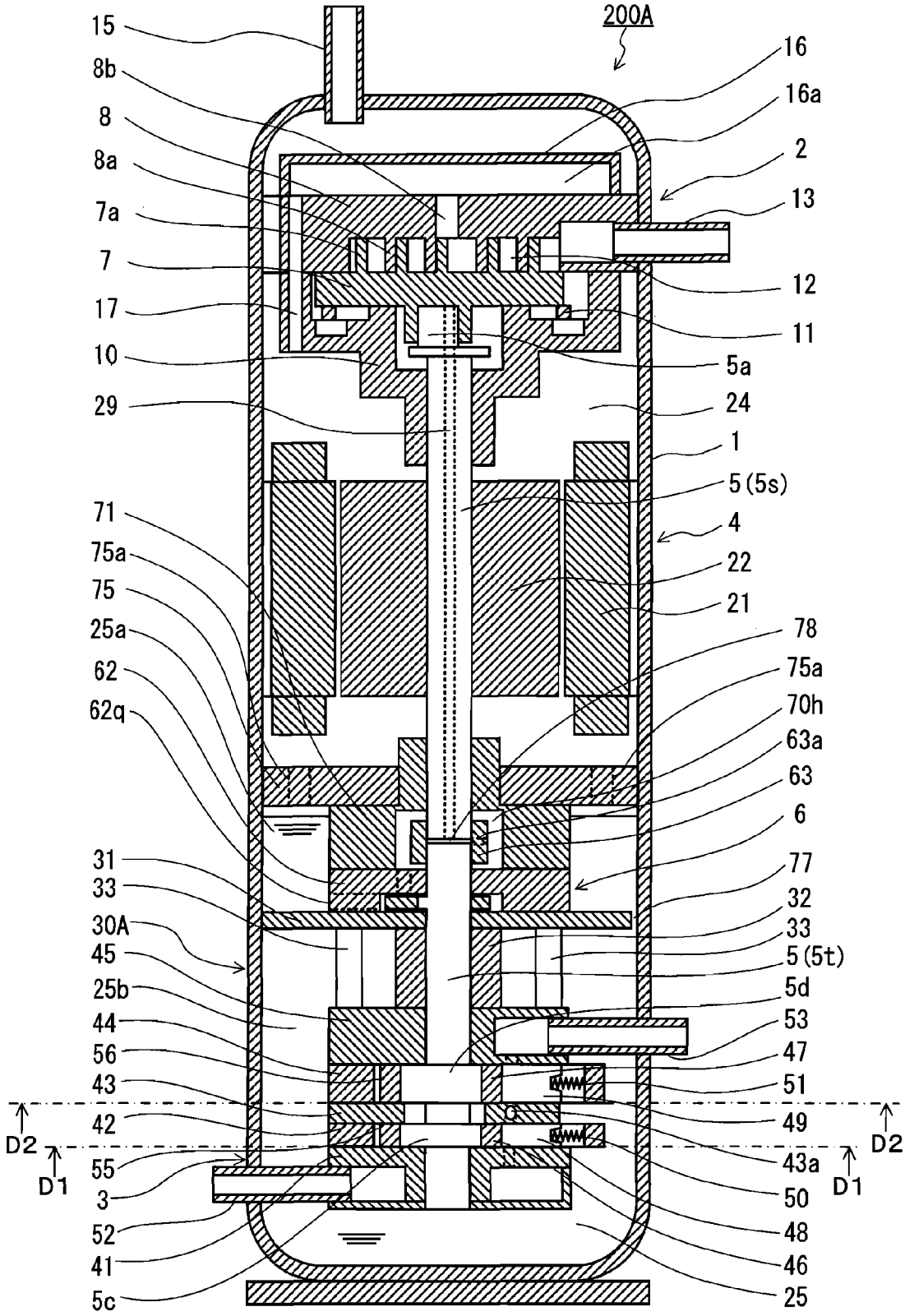
FIG. 1 is a vertical cross-sectional view of an expander-integrated compressor according to Embodiment 1 of the present invention.
Figure 2A:
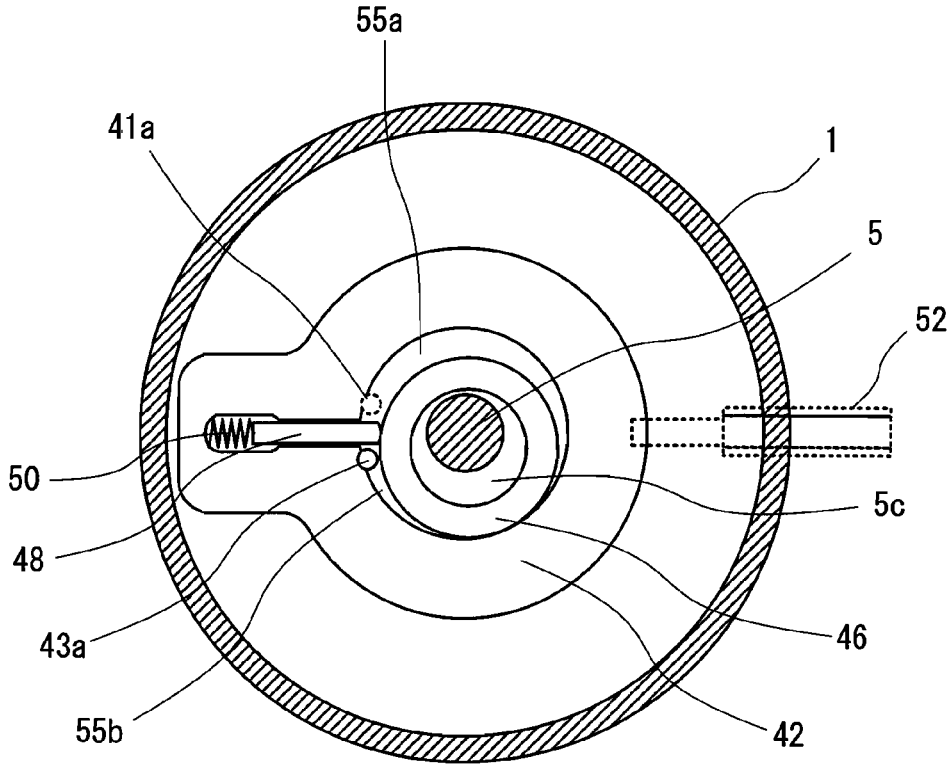
FIG. 2A is a transverse cross-sectional view of the expander-integrated compressor shown in FIG. 1, taken along the line D1-D1.
Figure 2B:
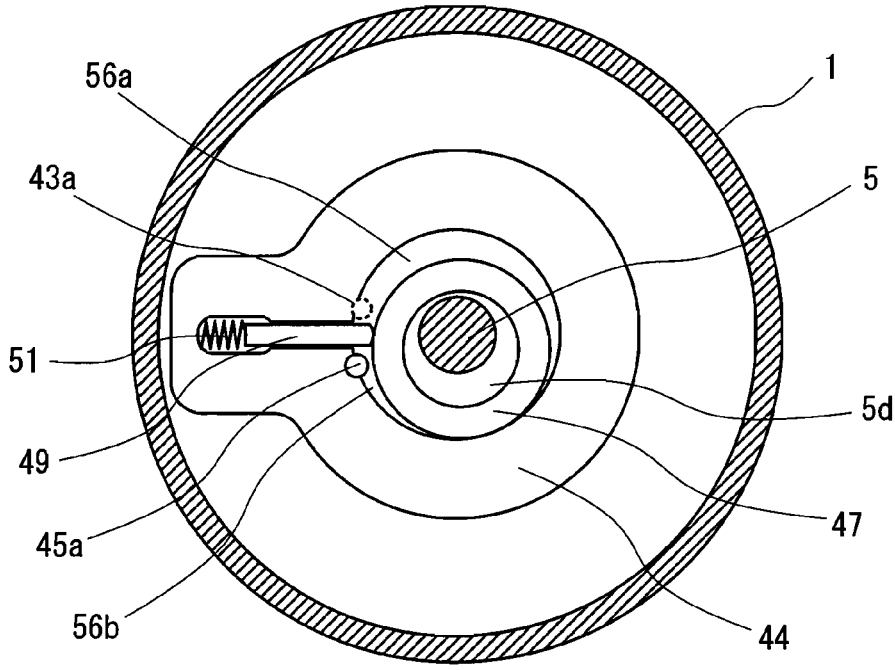
FIG. 2B also is a transverse cross-sectional view, taken along the line D2-D2.
Figure 3:
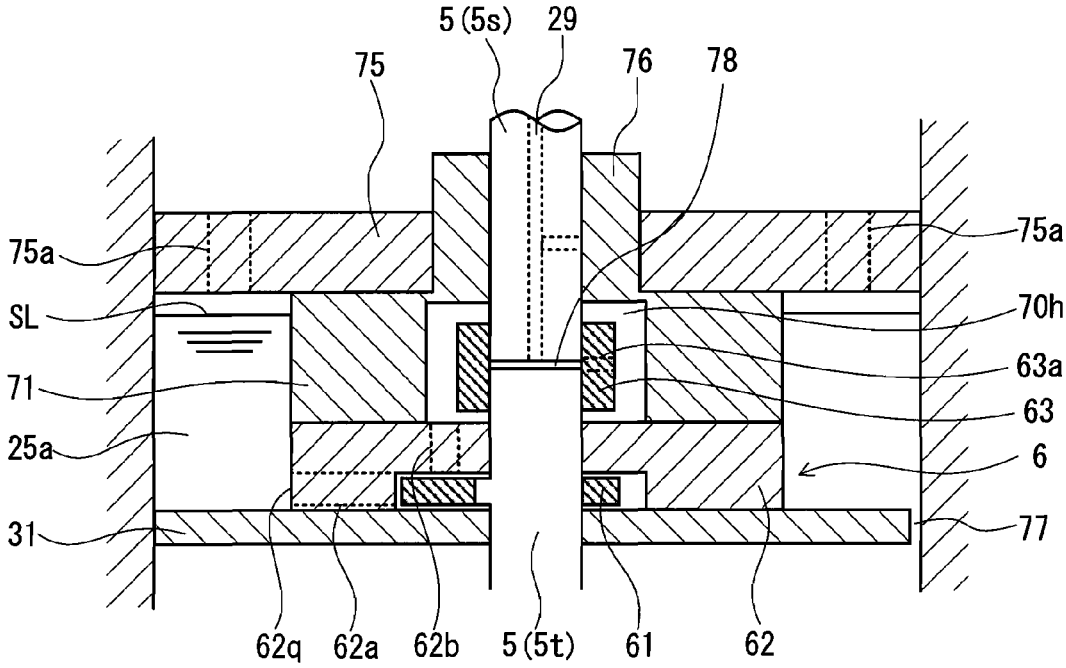
FIG. 3 is a partially enlarged view of FIG. 1.

Hereinbelow, embodiments of the present invention will be described with reference to the accompanying drawings. FIG. 1 is a vertical cross-sectional view of an expander-integrated compressor according to Embodiment 1 of the present invention. FIG. 2A is a transverse cross-sectional view of the expander-integrated compressor shown in FIG. 1, taken along the line D1-D1. FIG. 2B is a transverse cross-sectional view of the expander-integrated compressor shown in FIG. 1, taken along the line D2-D2. FIG. 3 is a partially enlarged view of FIG. 1.

As shown in FIG. 1, the expander-integrated compressor 200A includes: a closed casing 1; a scroll-type compression mechanism 2 disposed at an upper part of the closed casing 1; a two-stage rotary-type expansion mechanism 3 disposed at a lower part of the closed casing 1; a motor 4 disposed between the compression mechanism 2 and the expansion mechanism 3; a shaft 5 coupling the compression mechanism 2, the expansion mechanism 3, and the motor 4; an oil pump 6 disposed between the motor 4 and the expansion mechanism 3; and a heat insulating structure 30A disposed between the expansion mechanism 3 and the oil pump 6 and the motor 4. The motor 4 drives the shaft 5 to operate the compression mechanism 2. The expansion mechanism 3 recovers mechanical power from the expanding working fluid, and supplies the mechanical power to the shaft 5 to assist the shaft 5 in being driven by the motor 4. The working fluid is, for example, a refrigerant such as carbon dioxide and hydrofluorocarbon.

In this specification, an axial direction of the shaft 5 is defined as a vertical direction, and a side on which the compression mechanism 2 is disposed is defined as an upper side while a side on which the expansion mechanism 3 is disposed is defined as a lower side. The present embodiment employs the scroll-type compression mechanism 2 and the rotary-type expansion mechanism 3. The types of the compression mechanism 2 and the expansion mechanism 3, however, are not limited to these, and may be another positive displacement type. For example, both of the compression mechanism and the expansion mechanism may be of the rotary type or scroll-type.

As shown in FIG. 1, a bottom portion of the closed casing 1 is utilized as an oil reservoir 25. The oil is used for ensuring lubrication and sealing on sliding parts of the compression mechanism 2 and the expansion mechanism 3. The amount of the oil held in the oil reservoir 25 is adjusted so that an oil level SL (see FIG. 3) is higher than an oil suction port 62*q* of the oil pump 6 and is lower than the motor 4 when the closed casing 1 is placed upright, i.e., when the orientation of the closed casing 1 is determined so that the axial direction of the shaft 5 is parallel to the vertical direction. In other words, the locations of the oil pump 6 and the motor 4, and the shape and size of the closed casing 1 accommodating these elements are determined so that the oil level is present between the motor 4 and the oil suction port 62*q* of the oil pump 6.

The oil reservoir 25 includes an upper tank 25*a* in which the oil suction port 62*q* of the oil pump 6 is located, and a lower tank 25*b* in which the expansion mechanism 3 is located. The upper tank 25*a* and the lower tank 25*b* are separated from each other by a member (specifically, a partition plate 31 to be described later) constituting the heat insulating structure 30A. A space surrounding the oil pump 6 is filled with the oil held in the upper tank 25*a*, and a space surrounding the expansion mechanism 3 is filled with the oil held in the lower tank 25*b*. The oil in the upper tank 25*a* is used mainly for the compression mechanism 2, and the oil in the lower tank 25*b* is used mainly for the expansion mechanism 3.

In the axial direction of the shaft 5, the oil pump 6 is disposed between the compression mechanism 2 and the expansion mechanism 3 in such a manner that the level of the oil held in the upper tank 25*a* is higher than the oil suction port 62*q*. A support frame 75 is disposed between the motor 4 and the oil pump 6. The support frame 75 is fixed to the closed casing 1. The oil pump 6, the heat insulating structure 30A, and the expansion mechanism 3 are fixed to the closed casing 1 via the support frame 75. A plurality of through holes 75*a* are provided in an outer peripheral portion of the support frame 75 so that the oil having lubricated the compression mechanism 2 and the oil separated from the working fluid discharged into an internal space 24 of the closed casing 1 can return to the upper tank 25*a*. There may be a single through hole 75*a*.

The oil pump 6 draws the oil held in the upper tank 25*a*, and supplies it to the sliding parts of the compression mechanism 2. The oil having lubricated the compression mechanism 2 and returning to the upper tank 25*a* via the through holes 75*a* of the support frame 75 has a relatively high temperature because the oil received the heating effect from the compression mechanism 2 and the motor 4. The oil having returned to the upper tank 25*a* is drawn into the oil pump 6 again. On the other hand, the oil in the lower tank 25*b* is supplied to the sliding parts of the expansion mechanism 3. The oil having lubricated the sliding parts of the expansion mechanism 3 returns directly to the lower tank 25*b*. The oil held in the lower tank 25*b* has a relatively low temperature because it receives the cooling effect from the expansion mechanism 3. By disposing the oil pump 6 between the compression mechanism 2 and the expansion mechanism 3 and using the oil pump 6 to supply the oil to the compression mechanism 2, it is possible to keep the expansion mechanism 3 away from the circulation route of the high temperature oil that lubricates the compression mechanism 2. In other words, it is possible to separate the circulation route of the high temperature oil having lubricated the compression mechanism 2 from the circulation route of the low temperature oil having lubricated the expansion mechanism 3. Thereby, the heat transfer from the compression mechanism 2 to the expansion mechanism 3 via the oil is suppressed.

The effect of suppressing the heat transfer can be achieved with the oil pump 6 disposed between the compression mechanism 2 and the expansion mechanism 3 alone. Moreover, adding the heat insulating structure 30A can enhance the effect significantly.

During operation of the expander-integrated compressor 200A, the oil held in the oil reservoir 25 has a relatively high temperature in the upper tank 25*a*, and has a relatively low temperature around the expansion mechanism 3 in the lower tank 25*b*. The heat insulating structure 30A limits the flow of the oil between the upper tank 25*a* and the lower tank 25*b*, and is intended to maintain the state in which the high temperature oil is held in the upper tank 25*a* and the low temperature oil is held in the lower tank 25*b*. Furthermore, the existence of the heat insulating structure 30A increases, in the axial direction, a distance between the oil pump 6 and the expansion mechanism 3. This also can reduce the amount of the heat transfer from the oil filling the space surrounding the oil pump 6 to the expansion mechanism 3. The heat insulating structure 30A limits the oil flow between the upper tank 25*a* and the lower tank 25*b*, but does not forbid it. The flow of the oil from the upper tank 25*a* to the lower tank 25*b* and vice versa can occur in such a manner that the amount of the oil is balanced therebetween.

Next, the compression mechanism 2 and the expansion mechanism 3 will be described.

The scroll-type compression mechanism 2 includes an orbiting scroll 7, a stationary scroll 8, an Oldham ring 11, a bearing member 10, a muffler 16, a suction pipe 13, and a discharge pipe 15. The orbiting scroll 7 is fitted into an eccentric portion 5*a* of the shaft 5, and its self-rotation is restrained by the Oldham ring 11. The orbiting scroll 7, with a spiral-shaped lap 7*a* meshing with a lap 8*a* of the stationary scroll 8, scrolls in association with rotation of the shaft 5. A crescent-shaped working chamber 12 formed between the laps 7*a* and 8*a* reduces its volumetric capacity as it moves from outside to inside, compressing the working fluid drawn from the suction pipe 13. The compressed working fluid passes through a discharge port 8*b* provided at a center of the stationary scroll 8, an internal space 16*a* of the muffler 16, and a flow passage 17 penetrating through the stationary scroll 8 and the bearing member 10 in this order. The working fluid then is discharged into the internal space 24 of the closed casing 1. The oil having reached the compression mechanism 2 via an oil supply passage 29 in the shaft 5 lubricates sliding surfaces between the orbiting scroll 7 and the eccentric portion 5*a* and those between the orbiting scroll 7 and the stationary scroll 8. The working fluid having been discharged into the internal space 24 of the closed casing 1 is separated from the oil by a gravitational force or a centrifugal force while it stays in the internal space 24. Thereafter, the working fluid is discharged from the discharge pipe 15 toward a gas cooler.

The motor 4 driving the compression mechanism 2 via the shaft 5 includes a stator 21 fixed to the closed casing 1 and a rotor 22 fixed to the shaft 5. Electric power is supplied to the motor 4 from a terminal (not shown) disposed above the closed casing 1. The motor 4 may be either a synchronous motor or an induction motor. The motor 4 is cooled by the oil mixed in the working fluid discharged from the compression mechanism 2.

The oil supply passage 29 leading to the sliding parts of the compression mechanism 2 is formed in the shaft 5 and extends in the axial direction. The oil discharged from the oil pump 6 is fed into the oil supply passage 29. The oil fed into the oil supply passage 29 is supplied to the sliding parts of the compression mechanism 2 without passing through the expansion mechanism 3. Such a configuration can suppress effectively the heat transfer from the compression mechanism 2 to the expansion mechanism 3 via the oil because the oil travelling toward the compression mechanism 2 is not cooled at the expansion mechanism 3. Moreover, the formation of the oil supply passage 29 in the shaft 5 is desirable because an increase in the parts count and the problem of layout of the parts do not arise additionally.

Furthermore, in the present embodiment, the shaft 5 includes a first shaft 5*s* located on the compression mechanism 2 side, and a second shaft 5*t* located on the expansion mechanism 3 side and coupled to the first shaft 5*s*. In the first shaft 5*s*, the oil supply passage 29 leading to the sliding parts of the compression mechanism 2 is formed and extends in the axial direction. The oil supply passage 29 is exposed at a lower end face and an upper end face of the first shaft 5*s*. The first shaft 5*s* and the second shaft 5*t* are coupled to each other with a coupler 63 so that the mechanical power recovered by the expansion mechanism 3 is transferred to the compression mechanism 2. It should be noted, however, that the first shaft 5*s* and the second shaft 5*t* may be fitted directly into each other without using the coupler 63. It also is possible to employ a shaft made of a single component.

The expansion mechanism 3 includes a first cylinder 42, a second cylinder 44 with a larger thickness than that of the first cylinder 42, and an intermediate plate 43 for separating the cylinders 42 and 44. The first cylinder 42 and the second cylinder 44 are disposed concentrically with each other. The expansion mechanism 3 includes further: a first piston 46 that is fitted into an eccentric portion 5*c* of the shaft 5 and performs eccentric rotational motion in the first cylinder 42; a first vane 48 that is disposed reciprocably in a vane groove 42*a* (see FIG. 2A) of the first cylinder 42 and has one end contacting with the first piston 46; a first spring 50 that is in contact with another end of the first vane 48 and pushes the first vane 48 toward the first piston 46; a second piston 47 that is fitted into an eccentric portion 5*d* of the shaft 5 and rotates eccentrically in the second cylinder 44; a second vane 49 that is disposed reciprocably in a vane groove 44*a* (see FIG. 2B) of the second cylinder 44 and has one end contacting with the second piston 47; and a second spring 51 that is in contact with another end of the second vane 49 and pushes the second vane 49 toward the second piston 47.

The expansion mechanism 3 includes further an upper bearing member 45 and a lower bearing member 41 disposed in such a manner that they sandwich the first cylinder 42, the second cylinder 44, and the intermediate plate 43. The intermediate plate 43 and the lower bearing member 41 sandwich the first cylinder 42 from the top and bottom. The upper bearing member 45 and the intermediate plate 43 sandwich the second cylinder 44 from the top and bottom. Sandwiching the first cylinder 42 and the second cylinder 44 by the upper bearing member 45, the intermediate plate 43, and the lower bearing member 41 forms working chambers, the volumetric capacities of which vary according to the rotations of the pistons 46 and 47, in the first cylinder 42 and the second cylinder 44. The upper bearing member 45 and the lower bearing member 41 function also as bearing members for retaining the shaft 5 rotatably. Like the compression mechanism 2, the expansion mechanism 3 includes a suction pipe 52 and a discharge pipe 53.

As illustrated in FIG. 2A, a suction-side working chamber 55*a* (a first suction-side space) and a discharge-side working chamber 55*b* (a first discharge-side space), which are demarcated by the first piston 46 and the first vane 48, are formed in the first cylinder 42. As illustrated in FIG. 2B, a suction-side working chamber 56*a* (a second suction-side space) and a discharge-side working chamber 56*b* (a second discharge-side space), which are demarcated by the second piston 47 and the second vane 49, are formed in the second cylinder 44. The total volumetric capacity of the two working chambers 56*a* and 56*b* in the second cylinder 44 is larger than the total volumetric capacity of the two working chambers 55*a* and 55*b* in the first cylinder 42. The discharge-side working chamber 55*b* of the first cylinder 42 and the suction-side working chamber 56*a* of the second cylinder 44 are connected to each other via a through hole 43*a* provided in the intermediate plate 43, and they function as a single working chamber (expansion chamber). The high pressure working fluid flows into the working chamber 55*a* of the first cylinder 42 via a suction port 41*a* provided in the lower bearing member 41. The high pressure working fluid flown into the working chamber 55*a* of the first cylinder 42 expands and reduces its pressure in the expansion chamber formed by the working chamber 55*b* and the working chamber 56*a* while rotating the shaft 5. The low pressure working fluid is discharged from a discharge port 45*a* provided in the upper bearing member 45.

As described above, the expansion mechanism 3 is a rotary-type expansion mechanism including: the cylinders 42 and 44; the pistons 46 and 47 disposed in the cylinders 42 and 44, respectively, in such a manner that the pistons are fitted into the eccentric portions 5*c* and 5*d* of the shaft 5, respectively; and the bearing members 41 and 45 (closing members) that close the cylinders 42 and 44, respectively, so as to form the expansion chamber together with the cylinders 42 and 44 and the pistons 46 and 47. In a rotary-type fluid mechanism, it is necessary to lubricate a vane that partitions a space in the cylinder into two spaces, due to its structural limitation. However, when the entire mechanism is immersed in the oil, the vane can be lubricated in a remarkably simple manner, specifically, by exposing a rear end of the vane groove in which the vane is disposed to the inner space of the closed casing 1. In the present embodiment as well, the vanes 48 and 49 are lubricated in such a manner.

Figure 5:
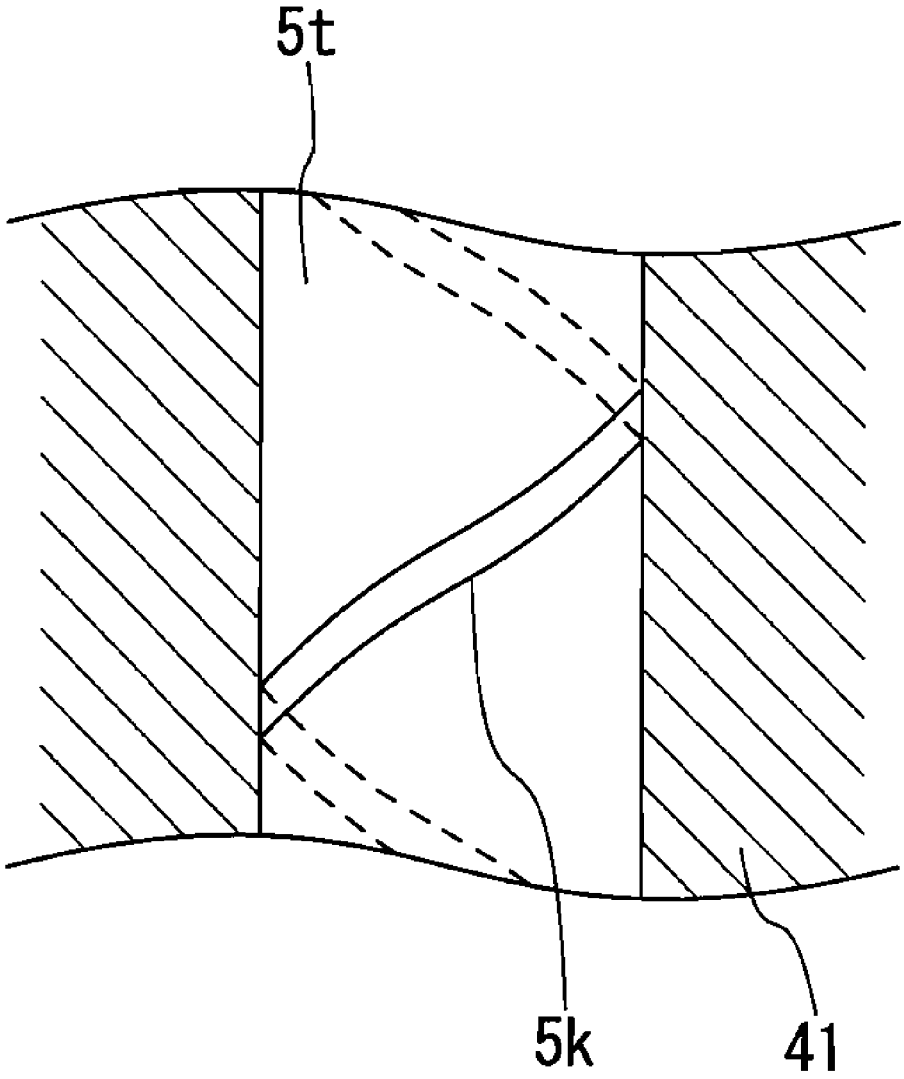
FIG. 5 is a schematic view showing an oil supply groove formed in an outer circumferential surface of a second shaft.

The oil can be supplied to other portions (for example, the bearing members 41 and 45) by, for example, forming, in an outer circumferential surface of the second shaft 5*t*, a groove 5*k* extending from a lower end of the second shaft 5*t* toward the cylinders 42 and 44 of the expansion mechanism 3, as shown in FIG. 5. The pressure applied to the oil held in the oil reservoir 25 is larger than the pressure applied to the oil that is lubricating the cylinders 42 and 44 and the pistons 46 and 47. Thus, the oil can flow through the groove 5*k* formed in the outer circumferential surface of the second shaft 5*t* and be supplied to the sliding parts of the expansion mechanism 3 without the help of an oil pump.

Next, the oil pump 6 will be described in detail.

As shown in FIG. 3, the oil pump 6 is a positive displacement pump configured to pump the oil by an increase or a decrease in the volumetric capacity of the working chamber associated with the rotation of the shaft 5. Adjacent to the oil pump 6, a hollow relay member 71 is provided to accommodate temporarily the oil discharged from the oil pump 6. The shaft 5 penetrates through central portions of the oil pump 6 and the relay member 71. Since an inlet of the oil supply passage 29 faces an internal space 70*h* of the relay member 71, the oil is fed into the oil supply passage 29. With such a configuration, it is possible to feed the oil into the oil supply passage 29 with no leakage without providing a separate oil supply pipe.

Figure 4:
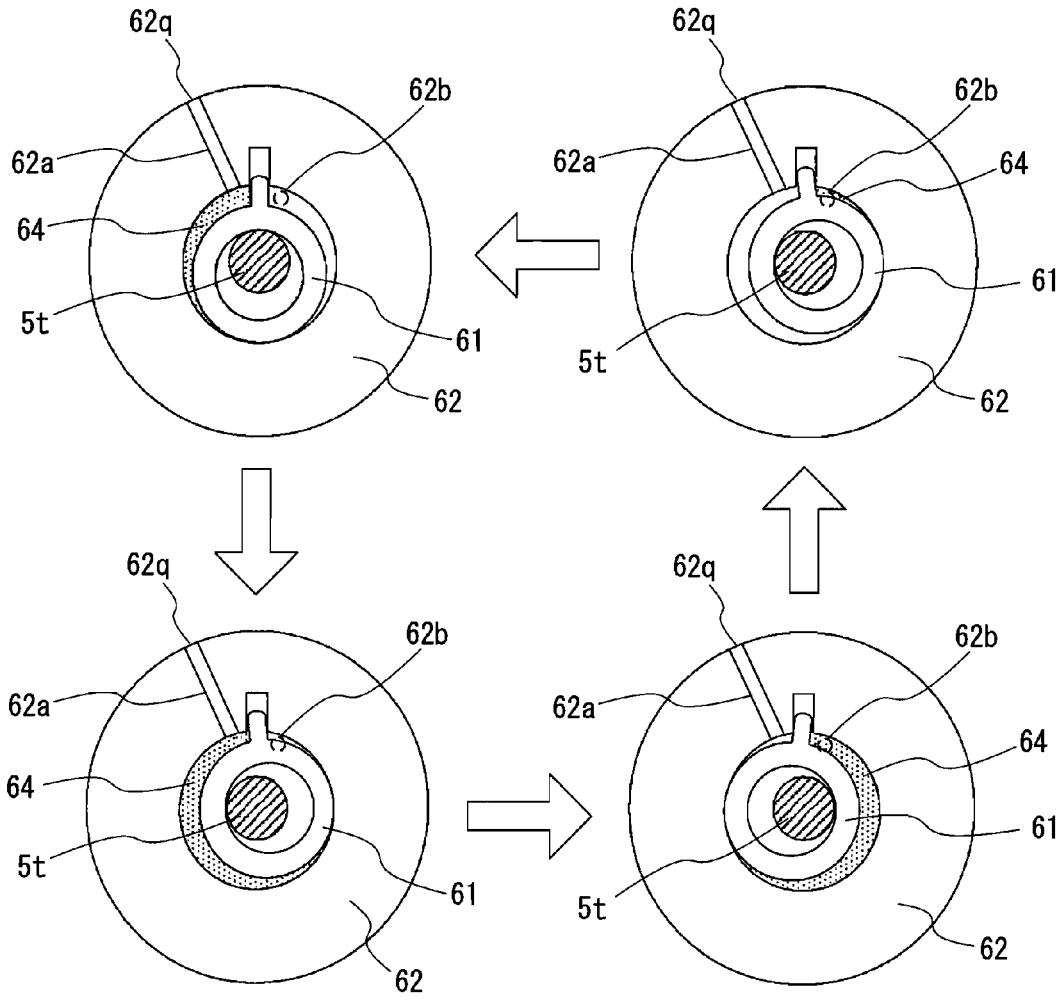
FIG. 4 is a plan view of an oil pump.

FIG. 4 shows a plan view of the oil pump 6. The oil pump 6 includes a piston 61 attached to the eccentric portion of the shaft 5 (the second shaft 5*t*), and a housing (cylinder) 62 for accommodating the piston 61. A crescent-shaped working chamber 64 is formed between the piston 61 and the housing 62. That is, the oil pump 6 employs a rotary-type fluid mechanism. An oil suction passage 62*a* and an oil discharge passage 62*b* are formed in the housing 62. The oil suction passage 62*a* connects the working chamber 64 to the oil reservoir 25 (specifically, the upper tank 25*a*). The oil discharge passage 62*b* connects the working chamber 64 to the internal space 70*h* of the relay member 71. The piston 61 rotates eccentrically in the housing 62 as the second shaft 5*t* rotates. Thereby, the volumetric capacity of the working chamber 64 fluctuates, drawing and discharging the oil. Such a mechanism utilizes directly the rotational motion of the second shaft 5*t* for pumping the oil without converting it into another motion by a cam mechanism or the like. Therefore, the mechanism has an advantage in that the mechanical loss is small. Moreover, the mechanism is highly reliable since it has a relatively simple structure.

As shown in FIG. 3, the oil pump 6 and the relay member 71 are disposed adjacent to each other vertically in the axial direction in such a manner that an upper face of the housing 62 of the oil pump 6 is in contact with a lower face of the relay member 71. The relay member 71 is closed by the upper face of the housing 62. Furthermore, the relay member 71 has a bearing portion 76 supporting the shaft 5 (the first shaft 5*s*). In other words, the relay member 71 functions also as a bearing supporting the shaft 5. The oil supply passage 29 in the shaft 5 is branched off in a section corresponding to the bearing portion 76 so that the bearing portion 76 is lubricated. The support frame 75 may have a portion equivalent to the bearing portion 76. Furthermore, the support frame 75 and the relay member 71 may be made of a single component.

In the present embodiment, a coupling portion at which the first shaft 5*s* and the second shaft 5*t* is coupled is formed in the internal space 70*h* of the relay member 71. Such a configuration makes it possible to feed the oil discharged from the oil pump 6 into the oil supply passage 29 formed in the first shaft 5*s* easily.

Furthermore, in the present embodiment, the first shaft 5*s* and the second shaft 5*t* are coupled to each other with the coupler 63, which is disposed in the internal space 70*h* of the relay member 71. That is, the relay member 71 plays the role of relaying the oil pump 6 and the oil supply passage 29, and the role of providing a space for placing the coupler 63. The first shaft 5*s* and the coupler 63 are coupled to each other in such a manner that they rotate synchronously. For example, grooves provided in an outer circumferential surface of the first shaft 5*s* engage with grooves provided in an inner circumferential surface of the coupler 63. The second shaft 5*t* and the coupler 63 also can be fixed to each other in the same way. The coupler 63 rotates in the relay member 71 in synchronization with the first shaft 5*s* and the second shaft 5*t*. The torque applied to the second shaft 5*t* by the expansion mechanism 3 is transferred to the first shaft 5*s* via the coupler 63.

An oil transmission passage 63*a* is formed in the coupler 63 and extends from an outer circumferential surface of the coupler 63 toward a center of rotation of the shaft 5. The oil transmission passage 63*a* can connect the internal space 70*h* of the relay member 71 to the oil supply passage 29 in the shaft 5. The oil fed from the oil pump 6 into the relay member 71 via the oil discharge passage 62*b* flows through the oil transmission passage 63*a* in the coupler 63, and is sent into the oil supply passage 29 in the shaft 5.

The oil supply passage 29 is exposed at the lower end face of the first shaft 5*s*. The coupler 63 couples the second shaft 5*t* to the first shaft 5*s* in such a manner that a clearance 78 capable of guiding the oil is formed therebetween. The oil transmission passage 63*a* communicates with the clearance 78. With such a configuration, the oil discharged from the oil pump 6 is fed into the oil supply passage 29 without interruption even when the coupler 63 rotates along with the shafts 5*s* and 5*t*. This makes it possible to lubricate the sliding parts of the compression mechanism 2 in a stable manner.

Figure 29:
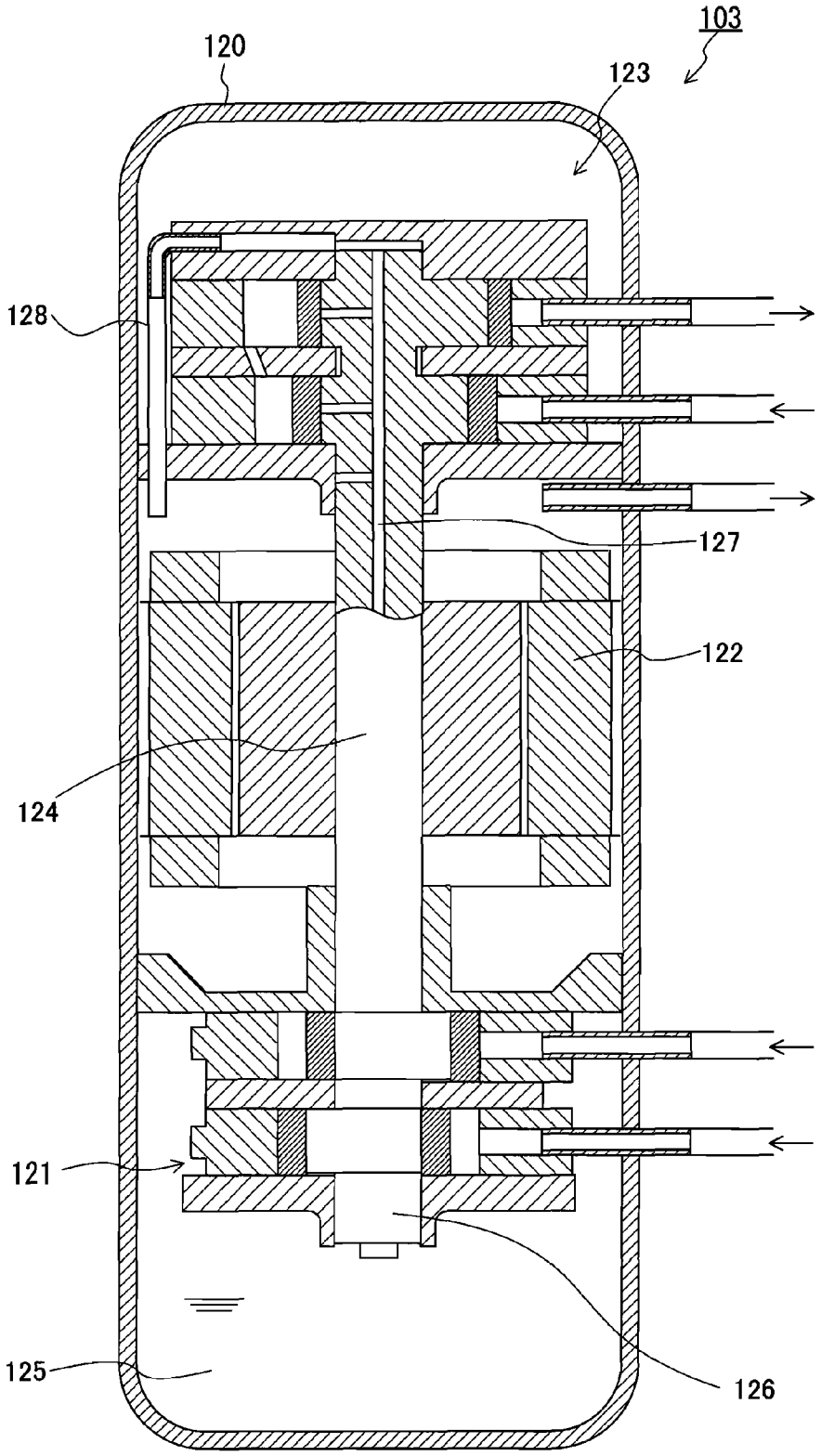
FIG. 29 is a cross-sectional view of a conventional expander-integrated compressor.

The following effects further can be obtained according to the present embodiment. The conventional expander-integrated compressors (see FIG. 29) have a structure in which oil is pumped up from a lower end of a shaft. Thus, when using two shafts coupled to each other, the coupling portion inevitably will be located somewhere on an oil supply passage, leading to possible oil leakage from the coupling portion. In contrast, the problem of oil leakage from the coupling portion basically does not occur when the coupling portion between the first shaft 5*s* and the second shaft 5*t* is utilized as an inlet to the oil supply passage 29, as in the present embodiment. And an oil supply passage does not need to be formed in the second shaft 5*t*. Moreover, the contamination generated at the coupling portion between the first shaft 5*s* and the second shaft 5*t* can be flushed by the circulating oil.

The positional relationship among the coupling portion (hereinafter referred to as the coupling portion of the shaft 5) between the first shaft 5*s* and the second shaft 5*t*, the inlet of the oil supply passage 29, and the oil pump 6 is not limited to the above. Modified examples related to the configuration around the oil pump 6 will be described below.

MODIFIED EXAMPLE 1

First, the locations of the oil pump 6 and the coupling portion of the shaft 5 are interchangeable vertically. In the modified example shown in FIG. 6, the oil pump 6 is disposed above the coupling portion of the shaft 5, and the relay member 171 is disposed adjacent to a lower face of the oil pump 6. The piston 61 of the oil pump 6 is fitted into an eccentric portion of the first shaft 5*s*. Such a positional relationship allows the high temperature oil to be drawn into the oil pump 6 more quickly, enhancing the effect of suppressing the heat transfer. This effect also can be achieved in the examples shown in FIG. 11, FIG. 12, and FIG. 13.

In Modified Examples 2 to 7 described below, an inlet 29*p* of the oil supply passage 29 is formed in an outer circumferential surface of the shaft 5, away from the coupling portion of the shaft 5. With such a configuration, the inlet 29*p* of the oil supply passage 29 is closer to a rotation axis of the shaft 5 than in the examples shown in FIG. 3 and FIG. 6. This decreases the centrifugal force applied to the oil, and increases the amount of oil circulation.

The oil pump 6 and the oil supply passage 29 are connected to each other via a relay passage for guiding to the oil supply passage 29 the oil discharged from the oil pump 6. Providing such a relay passage makes it possible to arrange the inlet 29*p* of the oil supply passage 29, the coupling portion of the shaft 5, and the oil pump 6 in an arbitrary order from the compression mechanism 2 side, resulting in a greater degree of freedom in designing. In addition, the relay passage can guide smoothly to the oil supply passage 29 the oil discharged from the oil pump 6 without leakage.

The relay passage may include a cylindrical space surrounding the shaft 5 in a circumferential direction. And the inlet 29*p* of the oil supply passage 29 may be formed in the outer circumferential surface of the shaft 5 so as to face the cylindrical space. Such a configuration makes it possible to guide the oil to the oil supply passage 29 at any angle throughout the entire rotation angle of the shaft 5. Hereinafter, further detail will be described with reference to the drawings.

MODIFIED EXAMPLE 2

Figure 7:
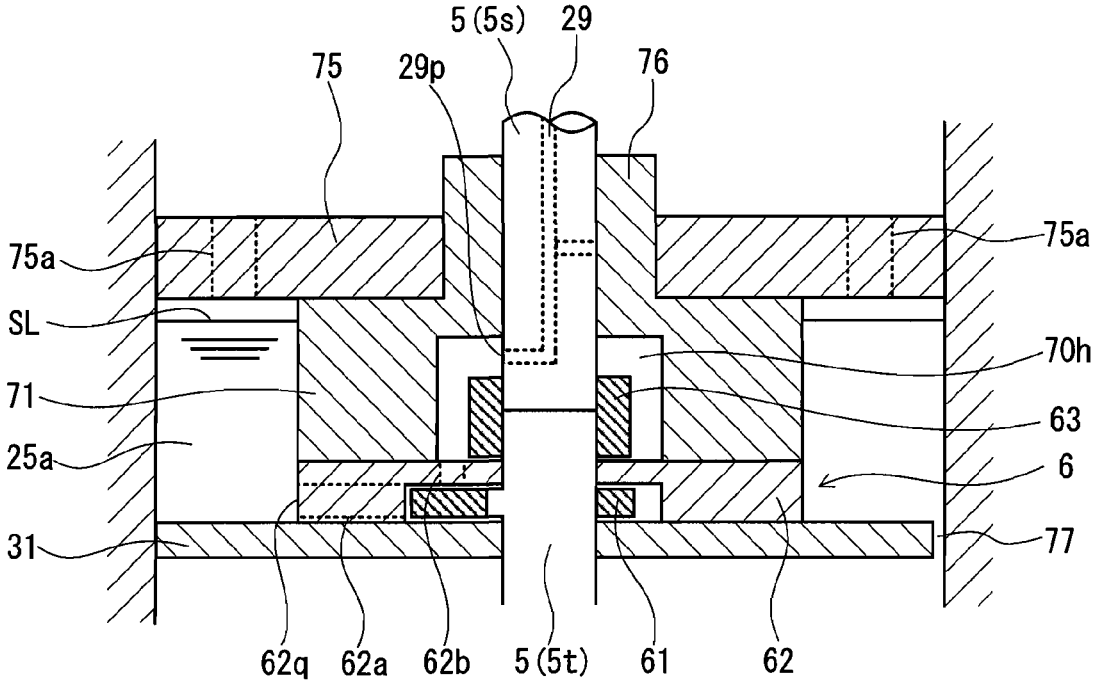
FIG. 7 is a cross-sectional view showing Modified Example 2 related to a configuration around the oil pump.

In the modified example shown in FIG. 7, the oil supply passage 29 is formed only in the first shaft 5*s*. The inlet 29*p* of the oil supply passage 29 is formed in the outer circumferential surface of the first shaft 5*s*, at a position slightly higher than a lower end portion of the first shaft 5*s* fitted into the coupler 63. The inlet 29*p* faces the internal space 70*h* of the relay member 71. As described earlier with reference to FIG. 3, the internal space 70*h* of the relay member 71 is connected to the working chamber of the oil pump 6 via the oil discharge passage 62*b*, and is filled with the oil discharged from the oil pump 6. That is, the internal space 70*h* of the relay member 71 constitutes the relay passage that guides to the oil supply passage 29 the oil discharged from the oil pump 6. The relay passage connects the oil pump 6 to the oil supply passage 29. The internal space 70*h* of the relay member 71 includes the cylindrical space surrounding the first shaft 5*s* in the circumferential direction. The inlet 29*p* of the oil supply passage 29 faces the cylindrical space. When the inlet 29*p* of the oil supply passage 29 is formed at a position away from the coupling portion of the shaft 5, the lower end face of the first shaft 5*s* and an upper end face of the second shaft 5*t* may be in contact with each other.

In the present modified example, the inlet 29*p* of the oil supply passage 29, the coupling portion of the shaft 5, and the oil pump 6 are arranged in this order from the compression mechanism 2 side. Disposing the oil pump 6 at a lowest possible location like this, preferably adjacent to the partition plate 31, makes it possible to increase readily the distance from the oil suction port 62*q* to the oil level SL, and makes it easy to ensure the capacity of the upper tank 25*a*. Accordingly, it is easy to respond to the fluctuation in the oil amount. This effect also can be achieved in the example shown in FIG. 3.

Since the coupling portion of the shaft 5 faces the internal space 70*h* functioning as the relay passage that connects the oil pump 6 to the oil supply passage 29, the contamination generated at the coupling portion can be flushed by the circulating oil. Furthermore, rotational resistance of the shaft 5 is reduced because a space surrounding the coupling portion is maintained at a relatively high temperature.

MODIFIED EXAMPLE 3

Figure 8:
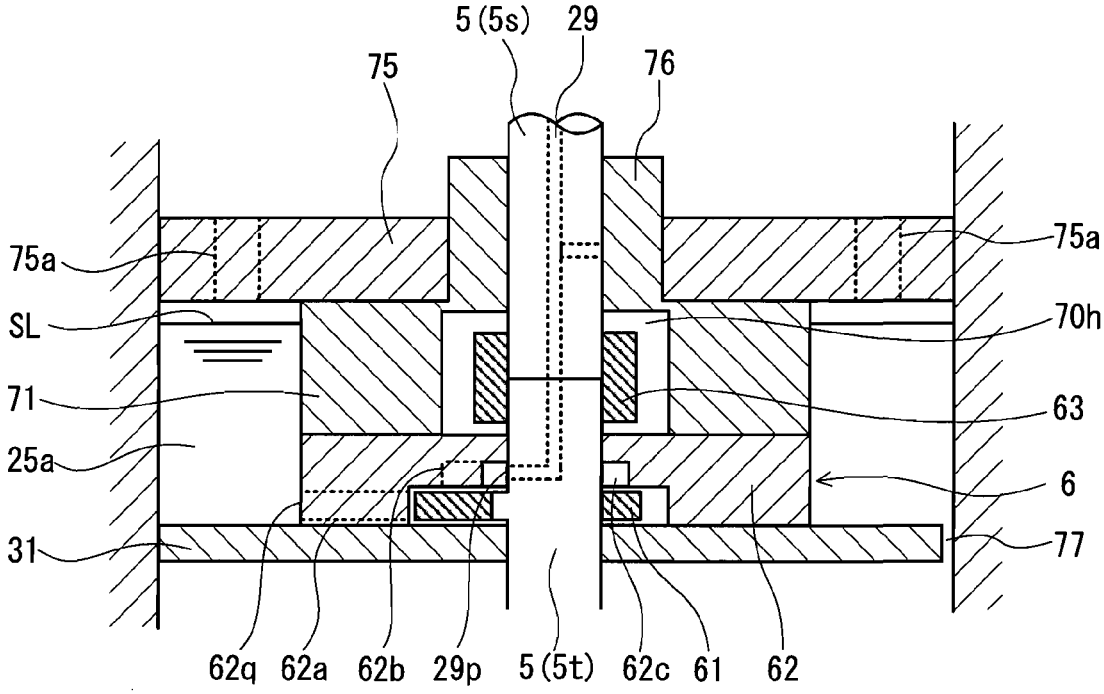
FIG. 8 is a cross-sectional view showing Modified Example 3 related to the configuration around the oil pump.

In the modified example shown in FIG. 8, the oil supply passage 29 is formed through the first shaft 5*s* and the second shaft 5*t*. The coupling portion of the shaft 5, the inlet 29*p* of the oil supply passage 29, and the oil pump 6 (specifically, the portion in which the working chamber is formed) are arranged in this order from the compression mechanism 2 side. Such an arrangement in which the oil pump 6 is located below the coupling portion of the shaft 5 makes assembling work of the expander-integrated compressor easier than an arrangement in which they are located in reverse order.

The assembling work of the expander-integrated compressor starts with fixing the compression mechanism 2, the motor 4, and the support frame 75 to a body portion of the closed casing 1 in order. The expansion mechanism 3 is assembled outside the closed casing 1, and eventually is accommodated in the closed casing 1 in such a manner that the expansion mechanism 3 is integrated with the compression mechanism 2 at the coupling portion of the shaft 5. At this time, a point to be considered is where the oil pump 6 is fixed at what timing. In an arrangement (for example, the arrangement shown in FIG. 6) in which the oil pump 6 is located above the coupling portion of the shaft 5, the assembling work of the oil pump 6 needs to be performed inside the closed casing 1. Since the work space in the closed casing 1 is small, and also a center of the oil pump 6 needs to be matched precisely with centers of the compression mechanism 2 and the motor 4, experienced skills are needed in order to assemble the oil pump 6 inside the closed casing 1 efficiently. In contrast, in an arrangement (for example, the arrangement of the present modified example shown in FIG. 8) in which the oil pump 6 is located below the coupling portion of the shaft 5, the positioning and assembling work of the oil pump 6 can be performed outside the closed casing 1 along with the assembling work of the expansion mechanism 3. As a result, excellent workability and enhanced productivity are attained. This effect can be achieved also in other examples having the same positional relationship as that of the present modified example.

As shown in FIG. 8, the inlet 29*p* of the oil supply passage 29 is formed in the outer circumferential surface of the second shaft 5*t*, between an upper end portion of the second shaft 5*t* and the portion (the eccentric portion) of the second shaft 5*t* into which the piston 61 is fitted. The oil pump 6 includes the housing 62 and the piston 61. The oil suction passage 62*a*, the oil discharge passage 62*b*, and a relay passage 62*c* are formed in the housing 62. The oil discharge passage 62*b* is a passage connecting the working chamber of the oil pump 6 and the relay passage 62*c*. The relay passage 62*c* is a cylindrical space surrounding the second shaft 5*t* in the circumferential direction. The inlet 29*p* of the oil supply passage 29 faces this cylindrical space. In the housing 62, the portion in which the oil suction passage 62*a* is formed and the portion in which the oil discharge passage 62*b* and the relay passage 62*c* are formed may be provided as separate components. The portion of the housing 62 in which the oil suction passage 62*a* is formed may be integrated with the partition plate 31.

The oil discharged from the oil pump 6 is guided to the oil supply passage 29 via the oil discharge passage 62*b* and the relay passage 62*c* without passing through the internal space 70*h* of the relay member 71. The relay member 71 serves as a housing for accommodating the coupler 63 and as a bearing for the shaft 5. It should be noted that the internal space 70*h* of the relay member 71 may be filled with the oil.

According to the present modified example, it is possible to shorten the total length of the oil discharge passage 62*b* and the relay passage 62*c*, in other words, the distance from the oil pump 6 to the oil supply passage 29. Thus, the present modified example excels from the viewpoint of preventing the pressure loss from increasing. This is advantageous for downsizing the oil pump 6 and for simplifying the structure of the oil pump 6. Also, as described in Modified Example 2 (FIG. 7), disposing the oil pump 6 at a lowest possible location makes it easy to respond to the fluctuation in the oil amount. According to the present modified example, it also can be said that the inlet 29*p* of the oil supply passage 29 is located inside the oil pump 6.

Figure 9:
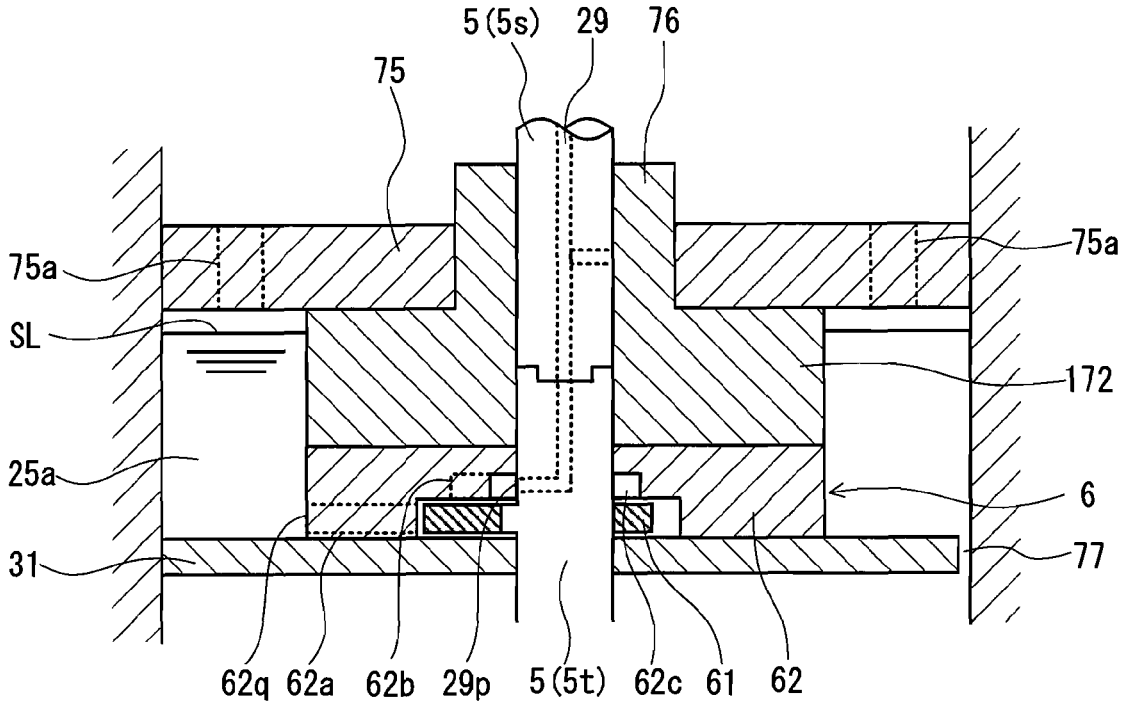
FIG. 9 is a cross-sectional view showing another coupling structure of the shaft.
Figure 10:
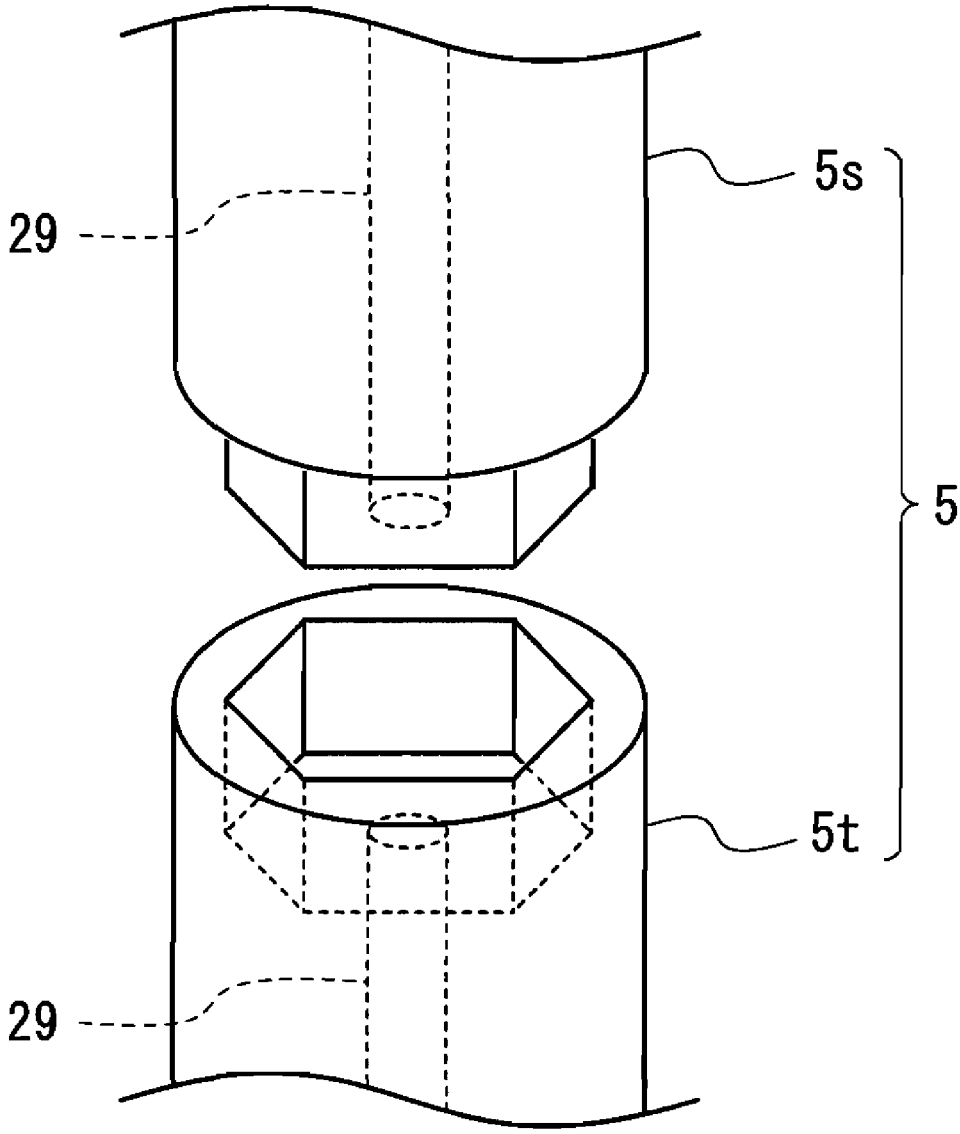
FIG. 10 is an exploded perspective view of the shaft shown in FIG. 9.

As shown in FIG. 9, the first shaft 5*s* may be coupled directly to the second shaft 5*t* by being fitted thereinto. This is applicable to other examples as well. According to the example shown in FIG. 9, a bearing member 172 can be provided instead of the relay member 71 (as in FIG. 8, etc.) accommodating the coupler. As shown in the exploded perspective view of FIG. 10, the coupling structure of the first shaft 5*s* and the second shaft 5*t* can be formed by fitting a projection of one of the shafts into a depression of the other shaft. Splines or serration may be formed at an end portion of the first shaft 5*s* and an end portion of the second shaft 5*t*.

MODIFIED EXAMPLE 4

Figure 11:
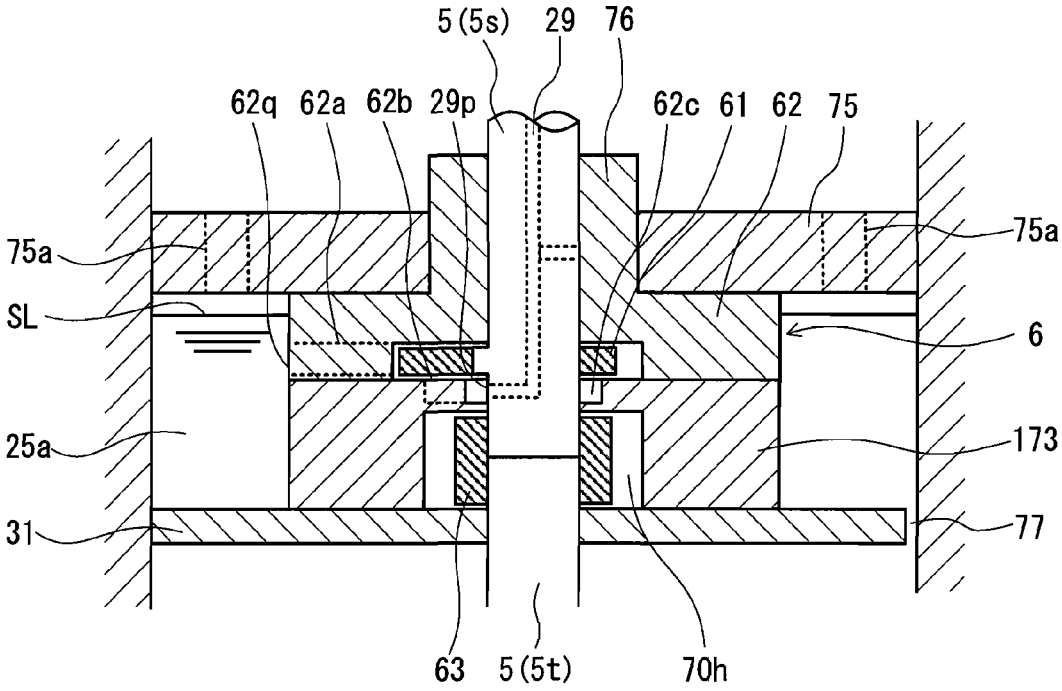
FIG. 11 is a cross-sectional view showing Modified Example 4 related to the configuration around the oil pump.

In the Modified Example shown in FIG. 11, the oil pump 6 (specifically, a portion in which a working chamber is formed), the inlet 29*p* of the oil supply passage 29, and the coupling portion of the shaft 5 are located in this order from the compression mechanism 2 side. The oil supply passage 29 is formed only in the first shaft 5*s*. The piston 61 of the oil pump 6 is fitted into the eccentric portion of the first shaft 5*s*. The relay member 173 with the internal space 70*h* for accommodating the coupler 63 is disposed adjacent to the partition plate 31. The oil discharge passage 62*b* and the relay passage 62*c* are formed in the relay member 173, on a side contacting the oil pump 6. The oil pump 6 and the oil supply passage 29 are connected to each other via the oil discharge passage 62*b* and the relay passage 62*c*. The bearing portion 76 may be a part of the housing 62 of the oil pump 6, or may be a part of the support frame 75.

Figure 6:
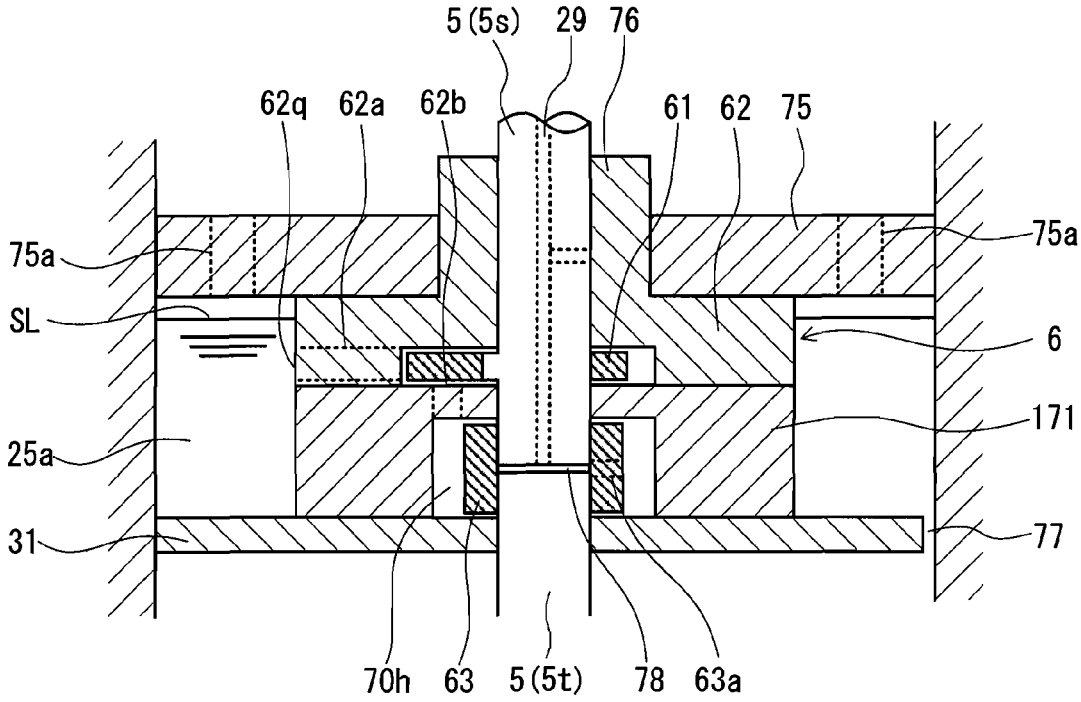
FIG. 6 is a cross-sectional view showing Modified Example 1 related to a configuration around the oil pump.

In the present modified example, the high temperature oil is drawn into the oil pump 6 quickly, so the effect of suppressing the heat transfer is enhanced, as described in the Modified Example 1 (FIG. 6).

MODIFIED EXAMPLE 5

Figure 12:
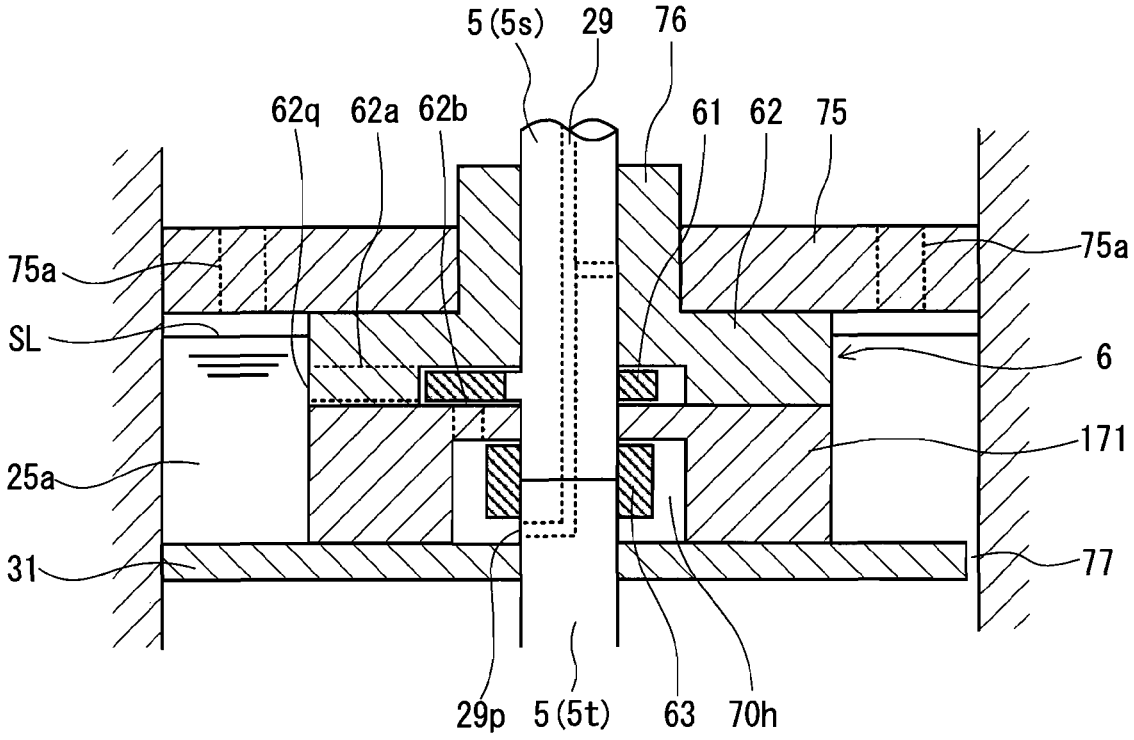
FIG. 12 is a cross-sectional view showing Modified Example 5 related to the configuration around the oil pump.

In the modified example shown in FIG. 12, the oil supply passage 29 is formed through the first shaft 5*s* and the second shaft 5*t*. The oil pump 6, the coupling portion of the shaft 5, and the inlet 29*p* of the oil supply passage 29 are arranged in this order from the compression mechanism 2 side. The internal space 70*h* of the relay member 171 constitutes the relay passage that guides the oil discharged from the oil pump 6 to the oil supply passage 29. The oil pump 6 and the oil supply passage 29 are connected to each other via the relay passage. The internal space 70*h* of the relay member 71 includes a cylindrical space surrounding the second shaft 5*t* in the circumferential direction. The inlet 29*p* of the oil supply passage 29 faces the cylindrical space.

In the present modified example, the coupling portion of the shaft 5 faces the internal space 70*h* of the relay member 171, so the contamination generated at the coupling portion can be flushed by the circulating oil, as described in the Modified Example 2 (FIG. 7). Rotational resistance of the shaft 5 is reduced because the space surrounding the coupling portion is maintained at a relatively high temperature. Furthermore, since the high temperature oil is drawn into the oil pump 6 quickly, the effect of suppressing heat transfer is enhanced.

MODIFIED EXAMPLE 6

Figure 13:
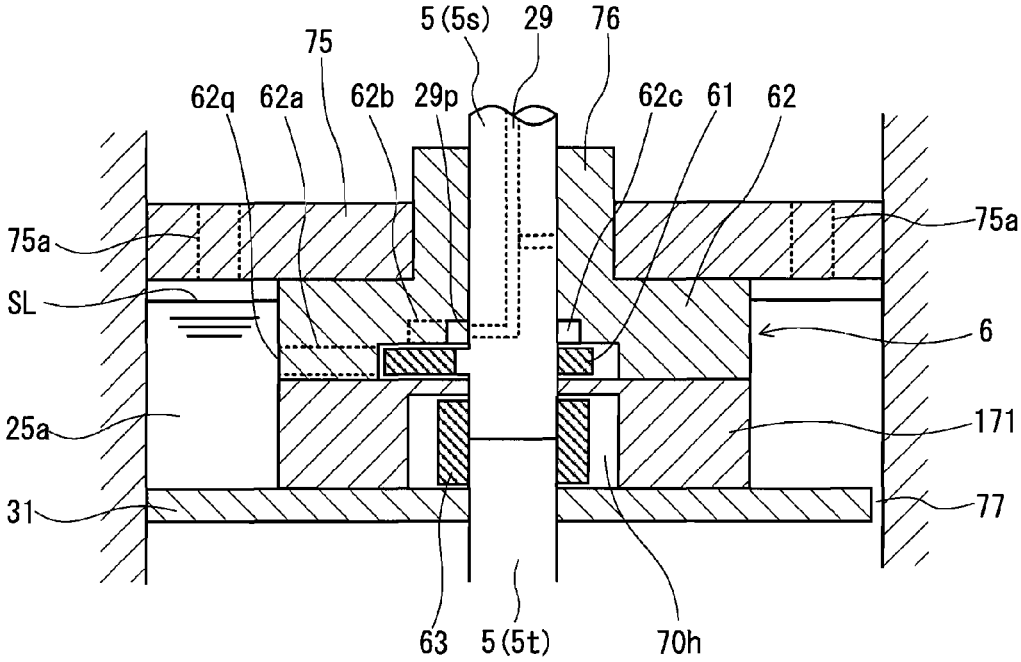
FIG. 13 is a cross-sectional view showing Modified Example 6 related to the configuration around the oil pump.

In the modified example shown in FIG. 13, the inlet 29*p* of the oil supply passage 29, the oil pump 6 (specifically, the portion in which the working chamber is formed), and the coupling portion of the shaft 5 are located in this order from the compression mechanism 2 side. The oil supply passage 29 is formed only in the first shaft 5*s*. The inlet 29*p* of the oil supply passage 29 is formed at a position slightly higher than the portion (the eccentric portion) of the oil pump 6, into the portion the piston 61 being fitted. The relay member 171 with the internal space 70*h* for accommodating the coupler 63 is disposed between the oil pump 6 and the partition plate 31. The oil suction passage 62*a*, the oil discharge passage 62*b*, and the relay passage 62*c* are formed in the housing 62 of the oil pump 6, as in the Modified Example 3 (FIG. 8). The positional relationship of the present modified example can minimize the overall length of the oil supply passage 29. Thus, the present modified example excels from the viewpoint of preventing the pressure loss from increasing.

MODIFIED EXAMPLE 7

Figure 14:
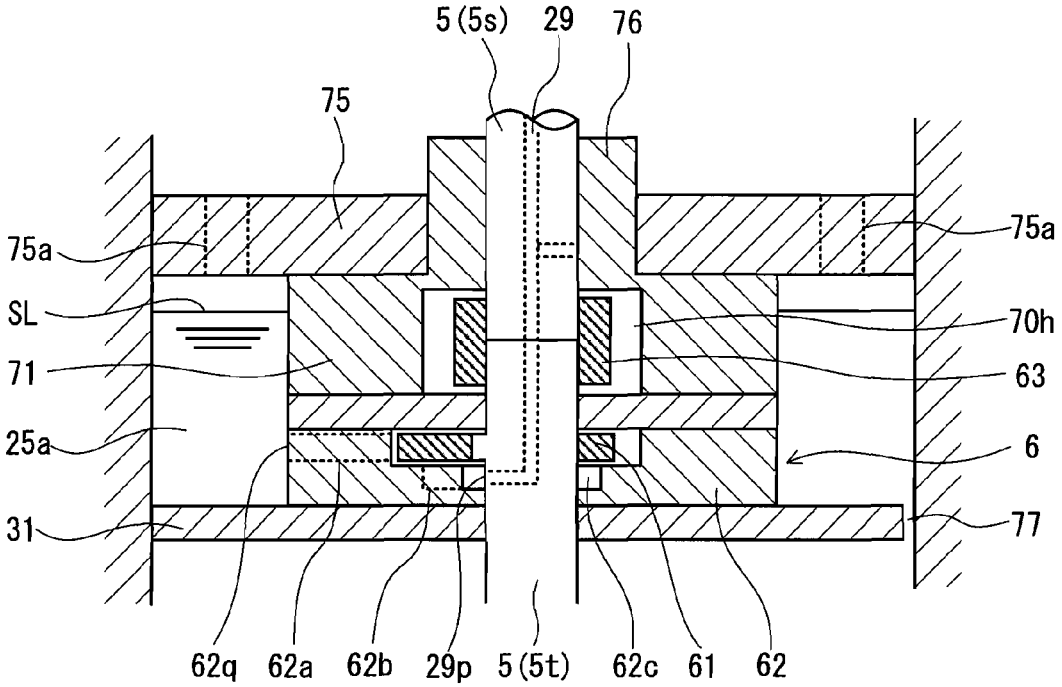
FIG. 14 is a cross-sectional view showing Modified Example 7 related to the configuration around the oil pump.

In the modified example shown in FIG. 14, the coupling portion of the shaft 5, the oil pump 6 (specifically, the portion in which the working chamber is formed), and the inlet 29*p* of the oil supply passage 29 are arranged in this order from the compression mechanism 2 side. The oil supply passage 29 is formed through the first shaft 5*s* and the second shaft 5*t*. The relay member 171 with the internal space 70*h* for accommodating the coupler 63 is disposed above the oil pump 6. As in the Modified Example 3 (FIG. 8), the oil suction passage 62*a*, the oil discharge passage 62*b*, and the relay passage 62*c* are formed in the housing 62 of the oil pump 62.

As described above, the positional relationship among the oil pump 6, the inlet 29*p* of the oil supply passage 29, and the coupling portion of the shaft 5 may be changed suitably depending on the points considered to be important.

Next, the heat insulating structure 30A will be described in detail.

As shown in FIG. 1, in the present embodiment, the heat insulating structure 30A is constituted by a member separate from the upper bearing member 45 (the closing member) of the expansion mechanism 3. Thereby, a sufficient distance can be ensured from the oil pump 6 to the second cylinder 44, enabling a higher thermal insulation effect to be achieved.

Specifically, the heat insulating structure 30A includes the partition plate 31 separating the upper tank 25*a* from the lower tank 25*b*, and spacers 32 and 33 disposed between the partition plate 31 and the expansion mechanism 3. The spacers 32 and 33 form, between the partition plate 31 and the expansion mechanism 3, a space filled with the oil held in the lower tank 25*b*. The oil filling the space defined by the spacers 32 and 33 itself serves as a heat insulating material, and forms thermal stratification in the axial direction.

The partition plate 31 has an upper face contacting a lower face of the housing 62 of the oil pump 6. That is, the working chamber 64 (see FIG. 4) in the housing 62 is formed by the upper face of the partition plate 31. The partition plate 31 has, at a center thereof, a through hole through which the shaft 5 extends. The constituent material for the partition plate 31 may be metal, such as carbon steel, cast iron, and alloy steel. The thickness of the partition plate 31 is not particularly limited, and does not necessarily have to be uniform as in the present embodiment.

The partition plate 31 preferably is shaped according to the shape of the lateral cross section (see FIG. 2) of the closed casing 1. In the present embodiment, the partition plate 31 with a circular outline is employed. The partition plate 31 has a size that can limit sufficiently the oil flow between the upper tank 25*a* and the lower tank 25*b*. Specifically, it is appropriate for the partition plate 31 to have an outer diameter almost equal to or slightly smaller than an inner diameter of the closed casing 1.

As shown in FIG. 1, a clearance 77 is formed between an inner surface of the closed casing 1, and an outer circumferential surface of the partition plate 31. The clearance 77 has a minimum width needed to allow the oil to flow between the upper tank 25*a* and the lower tank 25*b*. For example, it can be set to 0.5 mm to 1 mm in a direction of diameter of the shaft 5. Such a structure can limit the oil flow between the upper tank 25*a* and the lower tank 25*b* to a minimum amount needed.

The clearance 77 may or may not be formed along an entire circumference of the partition plate 31. For example, a cut-out for forming the clearance 77 can be provided at one or a plurality of locations in an outer peripheral portion of the partition plate 31. Furthermore, instead of the clearance 77 or besides the clearance 77, a through hole (a fine hole) allowing the oil to flow therethrough may be provided in the partition plate 31. It is desirable that, in a lateral direction perpendicular to the vertical direction, the through hole is located away from the oil suction port 62*q* of the oil pump 6 and the through hole 75*a* of the support frame 75 (that is, the through hole should overlap neither with the oil suction port 62*q* of the oil pump 6 nor with the through hole 75*a* of the support frame 75 in the vertical direction). This is because such a positional relationship allows the high temperature oil to be drawn into the oil pump 6 preferentially, preventing the high temperature oil from moving into the lower tank 25*b* via the through hole of the partition plate 31.

The spacer 32 is a first spacer 32 disposed around the shaft 5. The spacer 33 is a second spacer 33 disposed outside of the first spacer 32 in the diameter direction. In the present embodiment, the first spacer 32 has a circular cylindrical shape, and functions as a cover covering the second shaft 5*t*. Moreover, the first spacer 32 may function as a bearing supporting the second shaft 5*t*. The second spacer 33 may be a bolt or a screw for fixing the expansion mechanism 3 to the support frame 75, may be a member with a hole through which such a bolt or a screw penetrates, or may be a member only for ensuring a space. The spacers 32 and 33 may be integrated with the partition plate 31. In other words, the spacers 32 and 33 may be welded or brazed to the partition plate 31, or the spacers 32 and 33, and the partition plate 31 may be integrally formed as a single member.

A portion of the second shaft 5*t* above the partition plate 31 has a high temperature because the second shaft 5*t* extends through the oil pump 6 to project into the relay member 71. Thus, when the second shaft 5*t* is exposed to the space formed by the heat insulating structure 30A and is in contact with the oil held in the lower tank 25*b*, the heat transfer from the upper tank 25*a* to the lower tank 25*b* tends to occur via the second shaft 5*t*. When the second shaft 5*t* is covered with the first spacer 32 as in the present embodiment, it is possible to prevent the oil filling the space formed by the heat insulating structure 30A from contacting directly the second shaft 5*t* and being heated. That is, the first spacer 32 can suppress the heat transfer via the second shaft 5*t*. In addition, the first spacer 32 can prevent the second shaft 5*t* from stirring the oil held in the lower tank 25*b*.

The effect of suppressing the heat transfer via the second shaft 5*t* is enhanced further when the first spacer 32 has a lower thermal conductivity than those of the partition plate 31 and the second shaft 5*t*. For example, the partition plate 31 and the second shaft 5*t* may be made of cast iron, and the first spacer 32 may be made of stainless steel such as SUS 304. For the same reason, it is desirable that the second spacer 33 also is made of metal with a lower thermal conductivity. Of course, the partition plate 31 and the second shaft 5*t* may be made of stainless steel with a lower thermal conductivity. High/low of the thermal conductivity is judged within a normal temperature range (for example, 0° C. to 100° C.) of the oil during operation of the expander-integrated compressor 200A.

(Embodiment 2)

Figure 15:
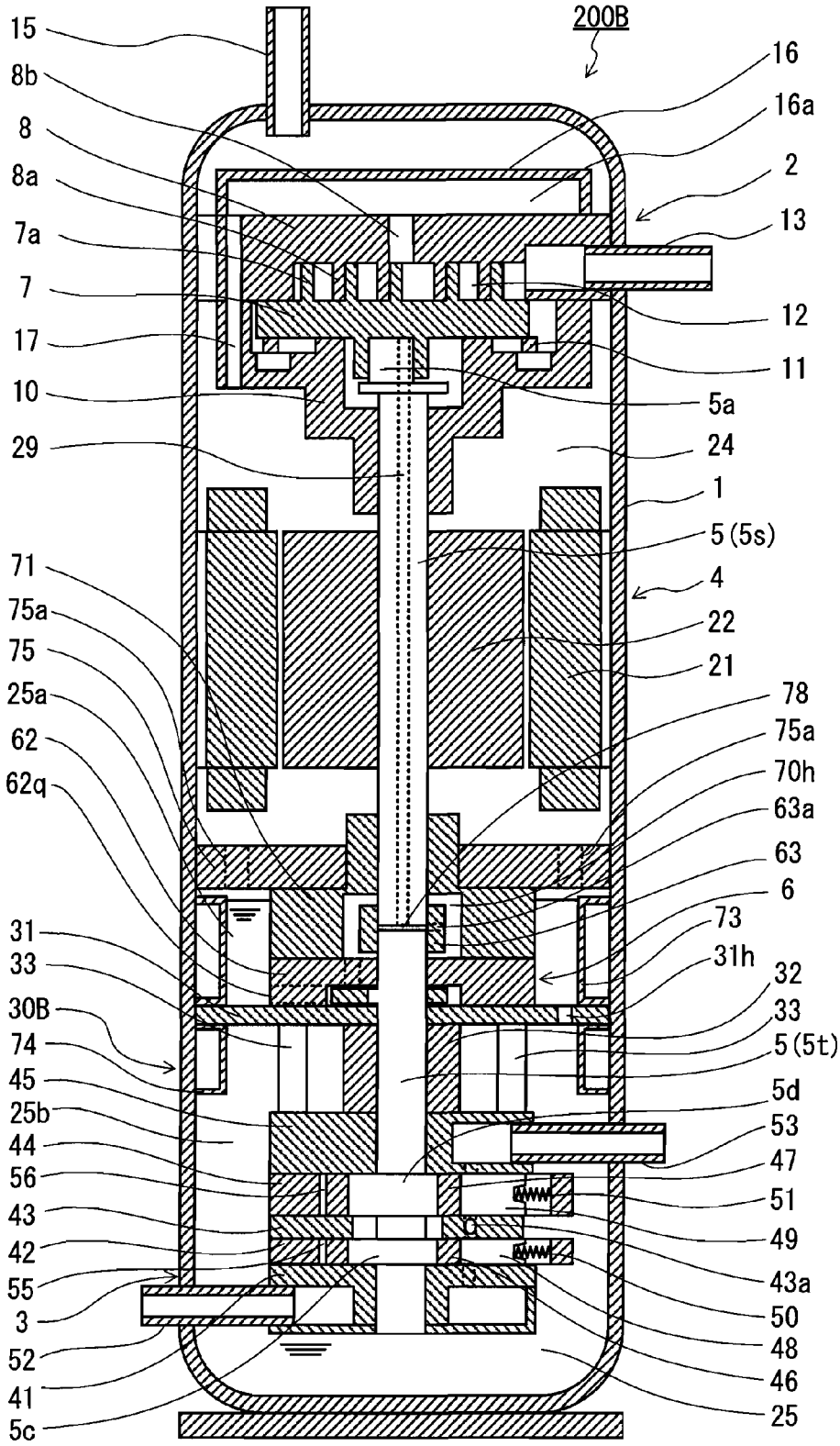
FIG. 15 is a vertical cross-sectional view of an expander-integrated compressor according to Embodiment 2.

FIG. 15 is a vertical cross-sectional view of an expander-integrated compressor according to Embodiment 2. The expander-integrated compressor 200B of the present embodiment is a modified example of the expander-integrated compressor 200A of the Embodiment 1, and a difference between them resides in the heat insulating structure provided between the oil pump 6 and the expansion mechanism 3. The elements given the same reference numerals are common between the embodiments.

As shown in FIG. 15, the heat insulating structure 30B of the expander-integrated compressor 200B includes the partition plate 31 and the spacers 32 and 33. Their configurations are the same as described in the Embodiment 1. It should be noted, however, that the partition plate 31 of the present embodiment has a through hole 31*h* for allowing the oil to flow between the upper tank 25*a* and the lower tank 25*b*. Of course, a clearance through which the oil can flow may be present between the inner surface of the closed casing 1 and the outer circumferential surface of the partition plate 31.

The heat insulating structure 30B includes further an upper, side heat-insulating body 73 covering the inner surface of the closed casing 1 from a position corresponding to the upper face of the partition plate 31 to a predetermined position above the partition plate 31, and a lower, side heat-insulating body 74 covering the inner surface of the closed casing 1 from a position corresponding to a lower face of the partition plate 31 to a predetermined position under the partition plate 31. The side heat-insulating bodies 73 and 74 can suppress the heat transfer from the upper tank 25*a* to the lower tank 25*b* via the closed casing 1. The effect of suppressing the heat transfer also can be achieved by providing only one of the upper, side heat-insulating body 73 and the lower, side heat-insulating body 74.

Figure 16:
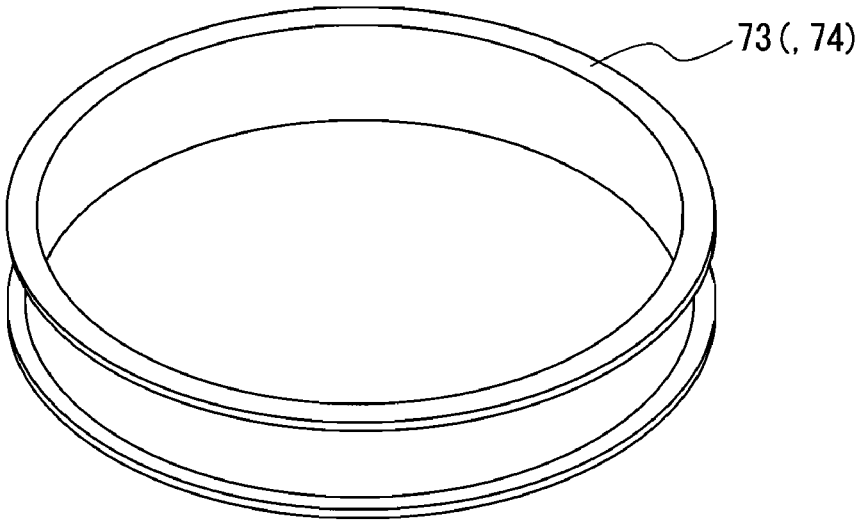
FIG. 16 is a perspective view of a heat insulating cover.

As shown in the perspective view of FIG. 16, the upper, side heat-insulating body 73 is an upper heat-insulating cover 73 forming, between itself and the inner surface of the closed casing 1, a cylindrical space filled with the oil held in the upper tank 25*a*. Likewise, the lower, side heat-insulating body 74 is a lower heat-insulating cover 74 forming, between itself and the inner surface of the closed casing 1, a cylindrical space filled with the oil held in the lower tank 25*b*. The heat insulating covers 73 and 74 may be made of metal, like the partition plate 31 and the spacers 32 and 33. The oil is allowed to enter into the spaces inside the heat insulating covers 73 and 74 via minute clearances formed between the heat insulating cover 73 and the closed casing 1 and between the heat insulating cover 74 and the closed casing 1, or via minute clearances formed between the heat insulating cover 73 and the partition plate 31 and between the heat insulating cover 74 and the partition plate 31. The oil filling the spaces inside the heat insulating covers 73 and 74 itself serves as a heat insulating material.

Figure 18:
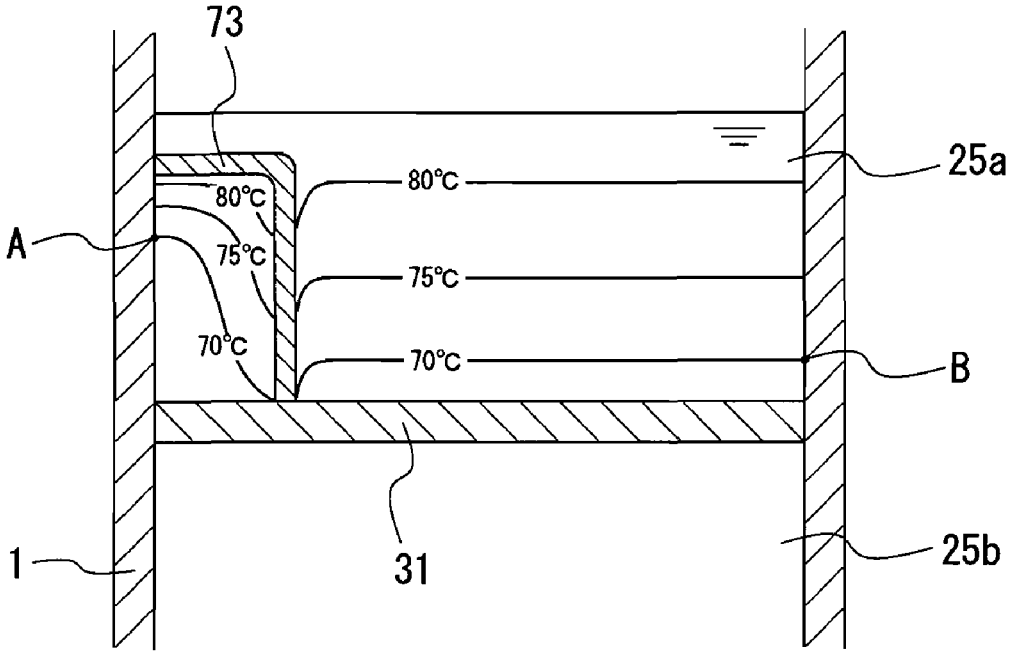
FIG. 18 is a view for illustrating the working of the heat insulating cover.

FIG. 18 is a view for illustrating the working of the heat insulating cover. The flow of the oil filling the space inside the heat insulating cover 73 is weaker than the flow of the oil outside the heat insulating cover 73 because the oil outside the heat insulating cover 73 is affected strongly by the drawing effect of the oil pump 6. Accordingly, as indicated by the isothermal lines in the figure, the temperature gradients of the oil filling the space inside the heat insulating cover 73 are different, in the axial direction, from those of the oil outside the heat insulating cover 73. For example, on the inner surface of the closed casing 1, the 70° C. isothermal line is more distanced from the partition plate 31 in the case in which the heat insulating cover 73 is provided (Point A on the left-hand side of the figure) than in the case in which the heat insulating cover 73 is not provided (Point B on the right-hand side of the figure). Generally, the amount of heat transfer is inversely proportional to cross-sectional area, heat resistance, and distance. Thus, the amount of heat transfer from the upper tank 25*a* to the lower tank 25*b* can be reduced as the distance from the partition plate 31 to a high temperature oil layer contacting the inner surface of the closed casing 1 increases.

Figure 17:
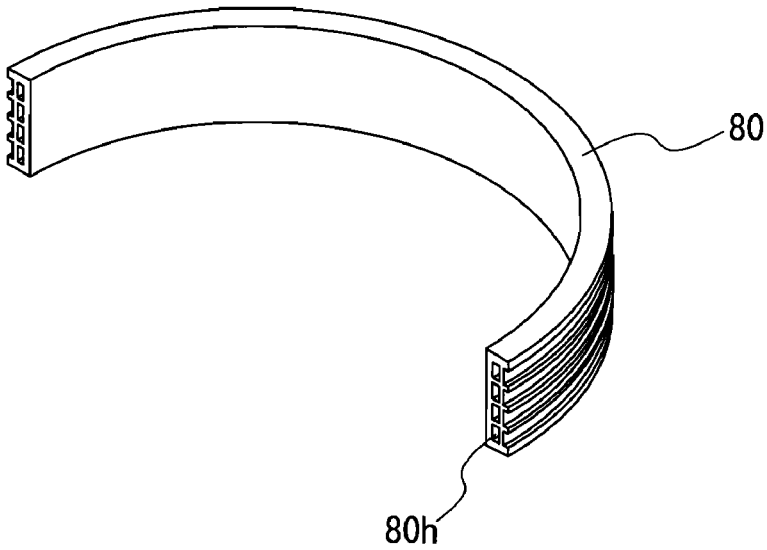
FIG. 17 is a sectional perspective view showing another example of the heat insulating cover.

It is desirable that the spaces formed by the heat insulating covers 73 and 74 are cylindrical as in the present embodiment. However, an arc-shaped space may be formed by covering a section of the inner surface of the closed casing 1 with an arc-shaped heat insulating cover. The above-mentioned effect also can be achieved in this case. The shape of the heat insulating cover is not particularly limited. For example, as shown in FIG. 17, a heat insulating cover 80 having air layers 80*h* therein suitably can be employed. Furthermore, the heat insulating covers 73, 74, and 80 may be integrated with the partition plate 31 by welding or brazing, or the heat insulating covers 73, 74, and 80, and the partition plate 31 may be integrally formed as a single member.

The side heat-insulating body is not limited to a cover as long as it is effective in suppressing the heat transfer from the upper tank 25*a* to the lower tank 25*b* via the closed casing 1. More specifically, the side heat-insulating body may be a lining covering the inner surface of the closed casing 1. It should be noted, however, that in a refrigeration cycle using carbon dioxide as a refrigerant, the internal space 24 of the closed casing 1 is filled with carbon dioxide in a supercritical state. Therefore, the lining needs to be resistant to the supercritical carbon dioxide. For example, a resin with excellent heat resistance and corrosion resistance, such as PPS (polyphenylene sulfide), may be used as the material of the lining.

(Embodiment 3)

Figure 19:
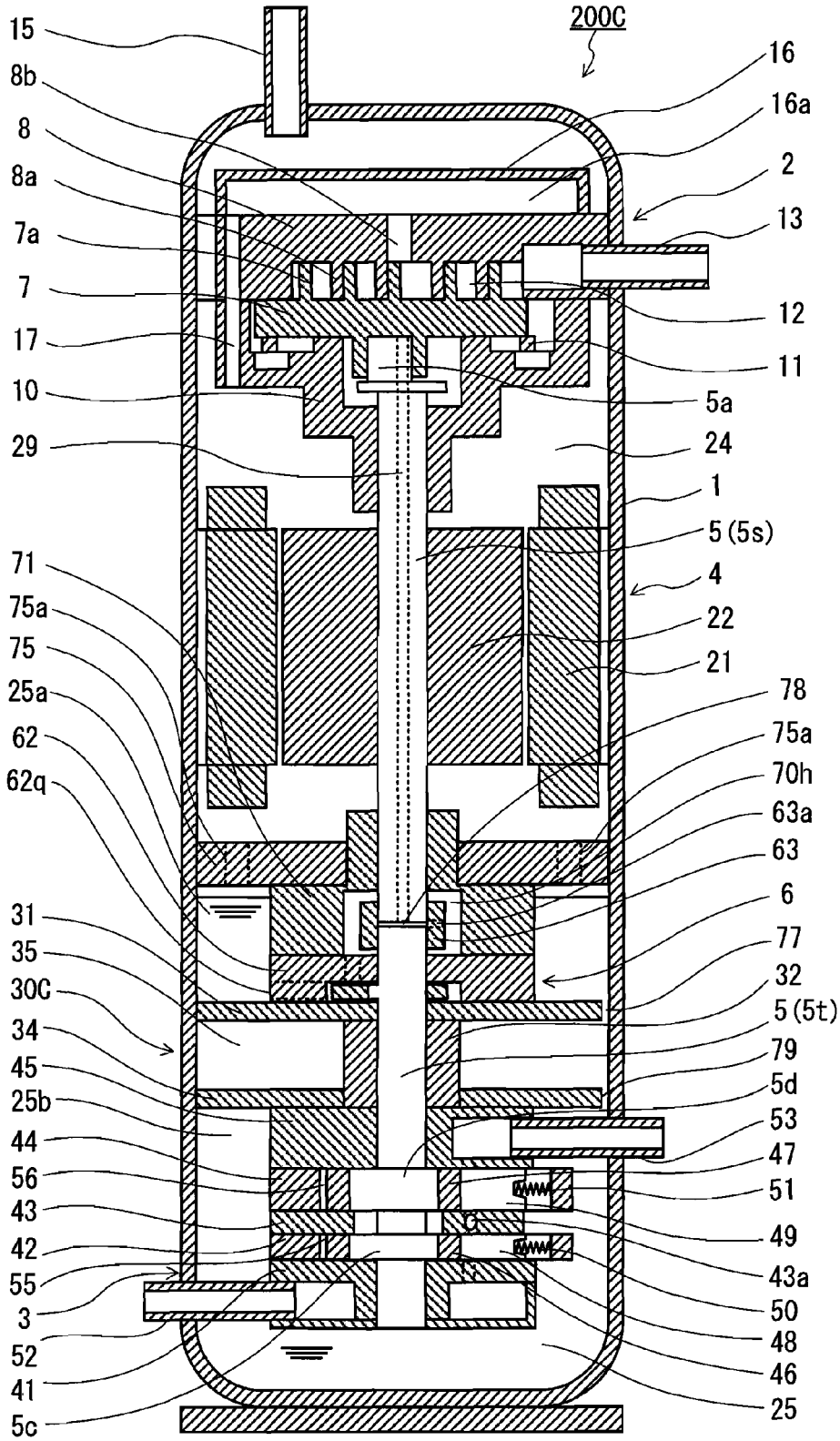
FIG. 19 is a vertical cross-sectional view of an expander-integrated compressor according to Embodiment 3.

FIG. 19 is a vertical cross-sectional view of an expander-integrated compressor according to Embodiment 3. A difference between the expander-integrated compressor 200C of the present embodiment and the expander-integrated compressor 200A of the Embodiment 1 resides in the heat insulating structure provided between the oil pump 6 and the expansion mechanism 3.

As shown in FIG. 19, the heat insulating structure 30C of the expander-integrated compressor 200C includes an upper partition plate 31 disposed on a side of the oil pump 6, a lower partition plate 34 disposed on a side of the expansion mechanism 3, and the spacer 32 that is disposed between the upper partition plate 31 and the lower partition plate 34. The spacer 32 forms, between the upper partition plate 31 and the lower partition plate 34, an internal space 35 that can be filled with a heat insulating fluid. The upper partition plate 31 is common with the partition plate 31 in the foregoing embodiments. The spacer 32 also is common with the spacer 32 in the foregoing embodiments. That is, the spacer 32 can function as the cover covering the second shaft 5*t*, and/or as the bearing supporting the second shaft 5*t*.

The lower partition plate 34 is disposed almost parallel to the upper partition plate 31, at a location adjacent to the upper bearing member 45 of the expansion mechanism 3. The shape, size, material, etc. of the lower partition plate 34 can be the same as those of the upper partition plate 31. The lower partition plate 34 has, at a center thereof, a through hole into which the spacer 32 is fitted. It should be noted, however, that the spacer 32 does not necessarily have to be fitted into the through hole at the center of the lower partition plate 34, and may be disposed on an upper face of the lower partition plate 34. Furthermore, the upper partition plate 31 may be integrated with the spacer 32, or the lower partition plate 34 may be integrated with the spacer 32. In addition, as described in the Embodiment 1, the spacer 32 may have a lower thermal conductivity than those of the partition plates 31 and 34, and the second shaft 5*t*.

As the heat insulating fluid, the oil held in the bottom portion of the closed casing 1 can be utilized. More specifically, the space 35 sandwiched by the upper partition plate 31 and the lower partition plate 34 is filled with the oil. A clearance 77 to allow the oil to enter into the space 35 is formed between the inner surface of the closed casing 1 and an outer circumferential surface of the upper partition plate 31. A similar clearance 79 also is formed between the inner surface of the closed casing 1 and an outer circumferential surface of the lower partition plate 34. Instead of the clearances 77 and 79, a through hole may be provided in the partition plates 31 and 34, respectively. The oil filling the internal space 35 of the heat insulating structure 30C forms thermal stratification.

As described in the Embodiment 1, the thermal stratification also can be formed with the upper partition plate 31 alone. Providing the lower partition plate 34, however, can stabilize the thermal stratification. As a result, the effect of suppressing the heat transfer from the upper tank 25*a* to the lower tank 25*b*, in other words, the effect of suppressing the heat transfer from the compression mechanism 2 to the expansion mechanism 3, is enhanced.

In the present embodiment, the oil is allowed to flow between the upper tank 25*a* and the lower tank 25*b* via the clearances 77 and 79. More specifically, the passage through which the oil flows between the upper tank 25*a* and the lower tank 25*b* is used as the passage through which the oil fills the internal space 35 of the heat insulating structure 30C. Such a configuration requires no additional passage, which is advantageous in simplifying the configuration.

(Embodiment 4)

Figure 20:
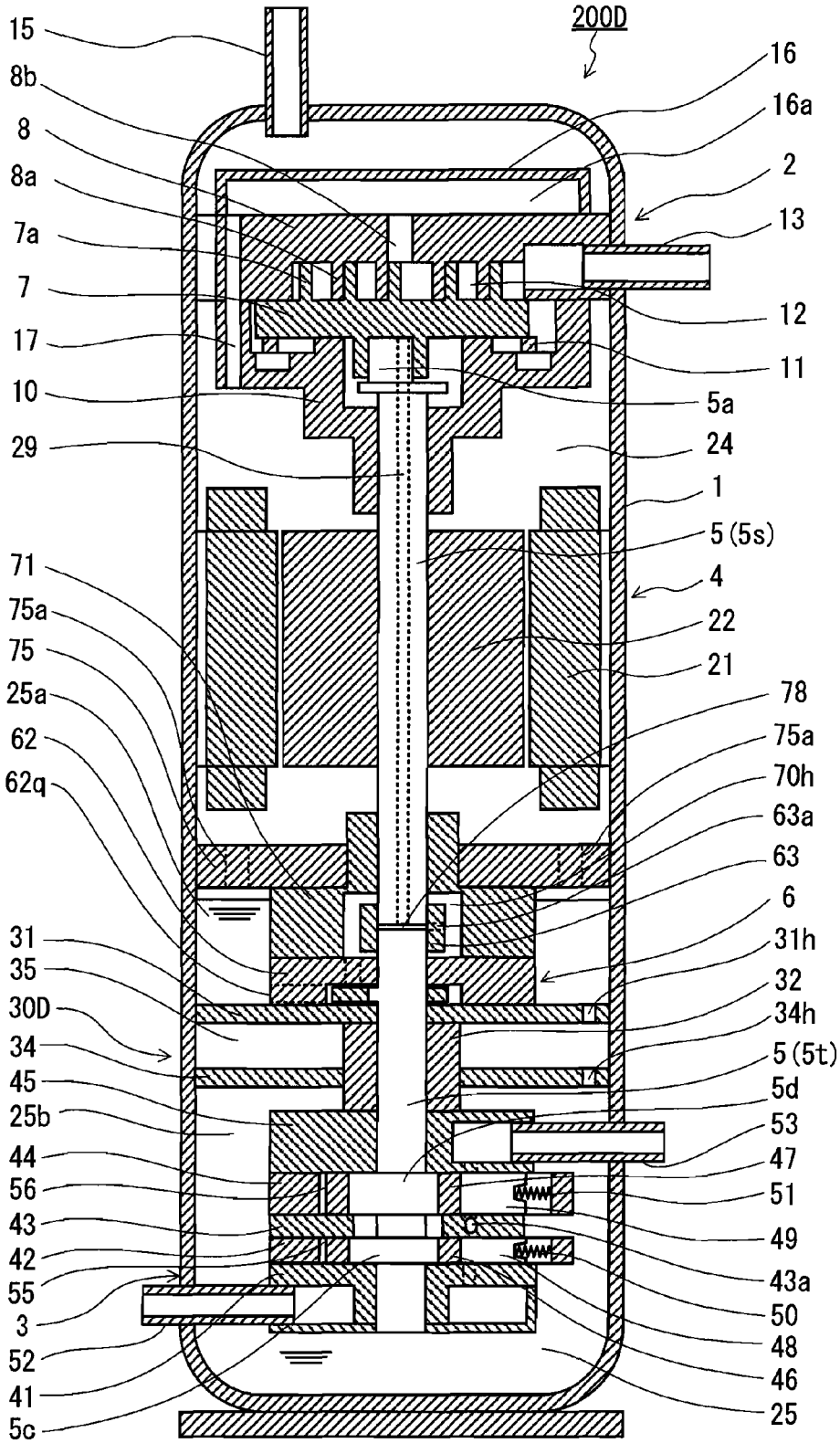
FIG. 20 is a vertical cross-sectional view of an expander-integrated compressor according to Embodiment 4.

FIG. 20 is a vertical cross-sectional view of an expander-integrated compressor according to Embodiment 4. The expander-integrated compressor 200D of the present embodiment is a modified example of the expander-integrated compressor 200C of the Embodiment 3, and a difference between them resides in the heat insulating structure provided between the oil pump 6 and the expansion mechanism 3.

As shown in FIG. 20, the heat insulating structure 30D of the expander-integrated compressor 200D includes the upper partition plate 31, the spacer 32, and the lower partition plate 34. The internal space 35 filled with the oil is formed between the upper partition plate 31 and the lower partition plate 34. Their configurations are as described in the Embodiment 3. In the present embodiment, the spacer 32 projects below a lower face of the lower partition plate 34, and the spacer 32 forms, between the lower partition plate 34 and the upper bearing member 45 of the expansion mechanism 3, a space filled with the oil held in the lower tank 25*b*. In other words, the lower partition plate 34 is somewhat spaced, in the axial direction, from the upper bearing member 45 of the expansion mechanism 3. Such a configuration does not allow the heat to be transferred directly between the expansion mechanism 3 and the lower partition plate 34, and allows the oil filling the space between the lower partition plate 34 and the upper bearing member 45 to serve as a heat insulating material. Thus, it is possible to suppress the heat transfer from the upper tank 25*a* to the lower tank 25*b* more in this case than in the case where the lower partition plate 34 and the upper bearing member 45 of the expansion mechanism 3 are in contact with each other.

In the present embodiment, the upper partition plate 31 and the lower partition plate 34 have the through hole 31*h* and a through hole 34*h*, respectively, as a passage leading to the internal space 35 of the heat insulating structure 30D. The oil fills the internal space 35 of the heat insulating structure 30D via the through holes 31*h* and 34*h*. The through holes 31*h* and 34*h* make it possible to guide the oil to the internal space 35 smoothly. Of course, the passage leading to the internal space 35 of the heat insulating structure 30D may be clearances formed between the inner surface of the closed casing 1 and the outer circumferential surface of the partition plate 31 and between the inner surface of the closed casing 1 and the outer circumferential surface of the partition plate 34. The through holes 31*h* and 34*h* each may be plural. From the viewpoint of suppressing the oil flow, however, the partition plates 31 and 34 are allowed to have the single through hole 31*h* and the single through hole 34*h*, respectively.

Furthermore, the through holes 31*h* and 34*h* provided in the upper partition plate 31 and the lower partition plate 34, respectively, serve also as a passage to allow the oil to flow between the upper tank 25*a* and the lower tank 25*b*. That is, also in the present embodiment, the oil flow between the upper tank 25*a* and the lower tank 25*b* is allowed via the internal space 35 of the heat insulating structure 30D. Such a configuration requires no additional passage, which is advantageous in simplifying the configuration. When the effect of balancing the oil amount is applied, the oil flows from the internal space 35 of the heat insulating structure 30D into each of the upper tank 25*a* and the lower tank 25*b*.

(Embodiment 5)

Figure 21:
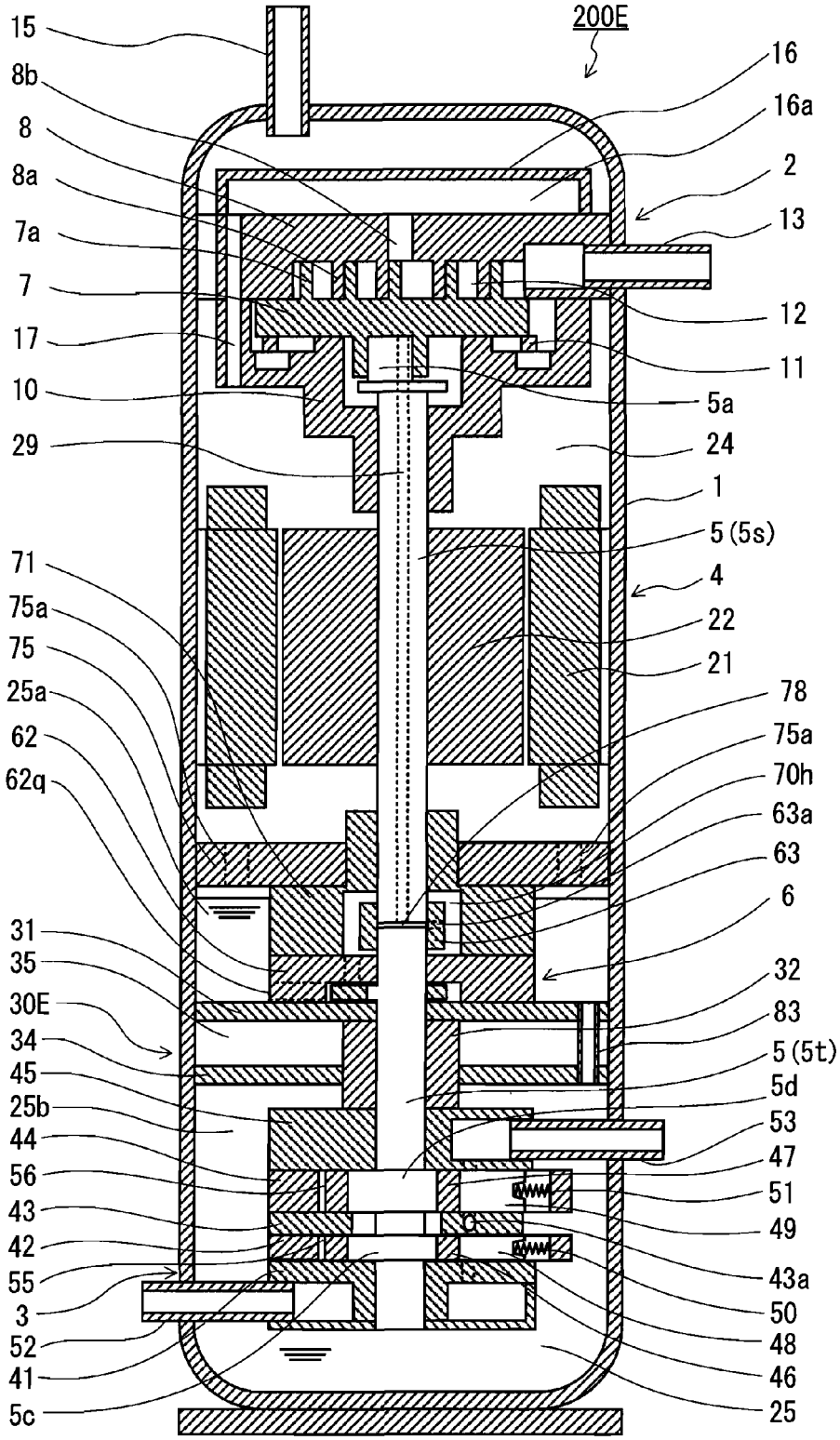
FIG. 21 is a vertical cross-sectional view of an expander-integrated compressor according to Embodiment 5.

FIG. 21 is a vertical cross-sectional view of an expander-integrated compressor according to Embodiment 5. The expander-integrated compressor 200E of the present embodiment is a modified example of the expander-integrated compressor 200D of the Embodiment 4, and a difference between them resides in the heat insulating structure provided between the oil pump 6 and the expansion mechanism 3.

As shown in FIG. 21, the heat insulating structure 30E of the expander-integrated compressor 200E includes the upper partition plate 31, the spacer 32, and the lower partition plate 34. The heat insulating structure 30E includes further a pipe 83 connecting the upper tank 25*a* and the lower tank 25*b* so as to allow the oil to flow between the upper tank 25*a* and the lower tank 25*b*. The pipe 83 has one end connected to the through hole provided in the upper partition plate 31, and another end connected to the through hole provided in the lower partition plate 34. Such a configuration can weaken further the flow of the oil filling the internal space 35 of the heat insulating structure 30E, forming more stable thermal stratification. As a result, the heat insulation effect by the heat insulating structure 30E is enhanced further.

As a passage through which the oil fills the internal space 35 of the heat insulating structure 30E, clearances may be formed between the outer circumferential surface of the partition plate 31 and the inner surface of the closed casing 1 and between the outer circumferential surface of the partition plate 34 and the inner surface of the closed casing 1, respectively, or a through hole may be provided in each of the partition plates 31 and 34, for example. Since the pipe 83 connecting the upper tank 25*a* and the lower tank 25*b* is provided in the present embodiment, the passage through which the oil fills the internal space 35 of the heat insulating structure 30E may be provided only in one of the upper partition plate 31 and the lower partition plate 34.

(Embodiment 6)

Figure 22:
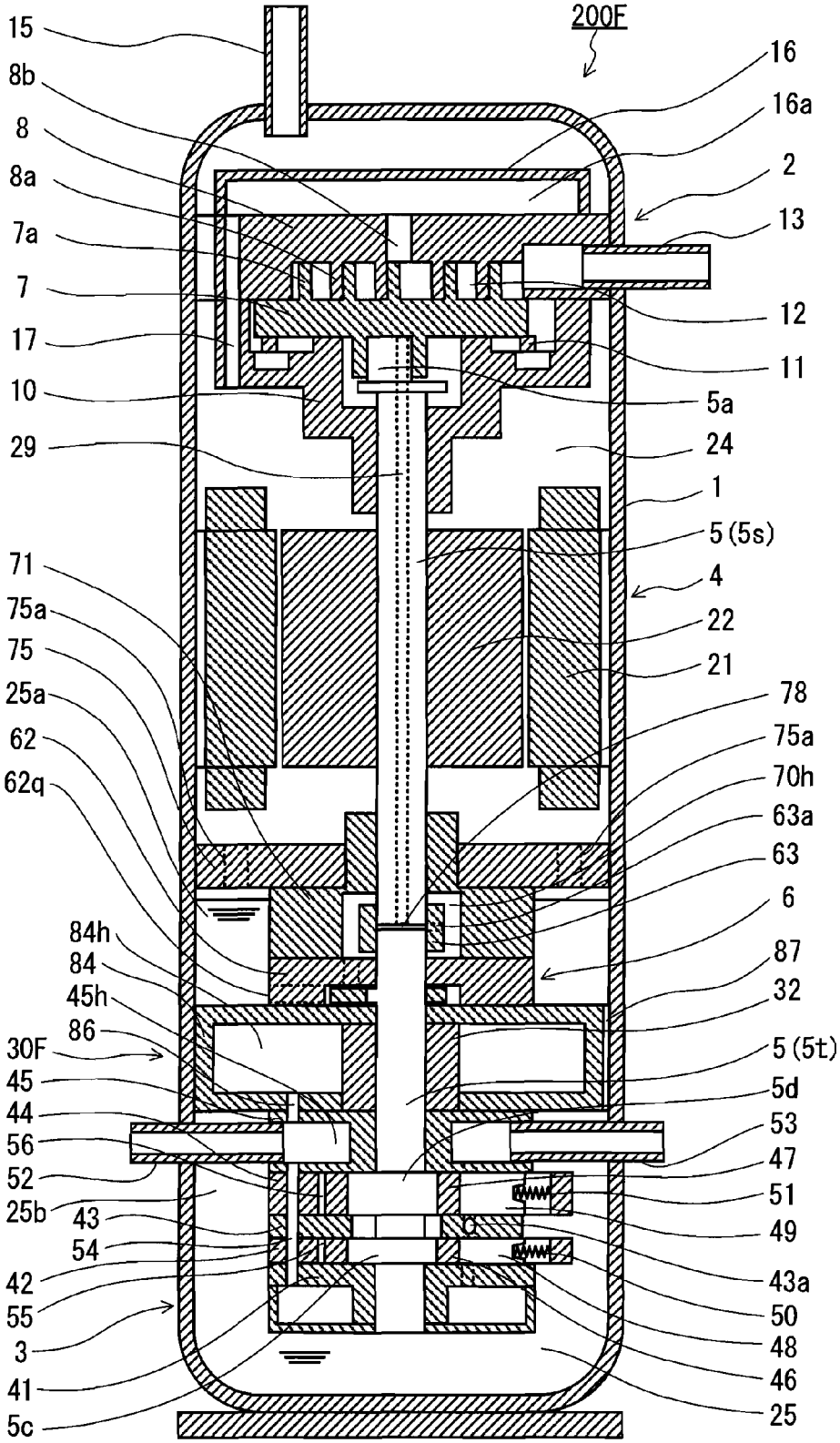
FIG. 22 is a vertical cross-sectional view of an expander-integrated compressor according to Embodiment 6.

FIG. 22 is a vertical cross-sectional view of an expander-integrated compressor according to Embodiment 6. The expander-integrated compressor 200F of the present embodiment is a modified example of the expander-integrated compressor 200C of the Embodiment 3, and differences between them reside in the heat insulating structure provided between the oil pump 6 and the expansion mechanism 3, and in a suction passage for the working fluid at the expansion mechanism 3.

As shown in FIG. 22, the heat insulating structure 30F of the expander-integrated compressor 200F includes a housing 84 having an internal space 84*h* that can be filled with the heat insulating fluid, and the spacer 32 functioning as the cover covering the shaft 5 penetrating through a central portion of the housing 84. The spacer 32 is as described in the foregoing embodiments. The housing 84 includes a portion equivalent to the upper partition plate, a portion equivalent to a the lower partition plate, and a circular side portion connecting these two portions. The housing 84 forms the internal space 84*h* of the heat insulating structure 30F. An upper face of the housing 84 is in contact with the lower face of the oil pump 6, and a lower face of the housing 84 is in contact with an upper face (an upper face of the upper bearing member 45) of the expansion mechanism 3. The oil is allowed to flow between the upper tank 25*a* and the lower tank 25*b* via a clearance 87 formed between the side portion of the housing 84 and the closed casing 1.

The internal space 84*h* of the heat insulating structure 30F is a space isolated from the internal space (specifically, the lower tank 25*b* of the oil reservoir 25) of the closed casing 1, and the oil is not allowed to enter therein. Instead, the internal space 84*h* can be filled with the working fluid that is not expanded yet. More specifically, the heat insulating structure 30F includes further a branch passage 86 for supplying, as the heat insulating fluid, a part of the working fluid to be drawn into the expansion mechanism 3 to the internal space 84*h* of the heat insulating structure 30F. The branch passage 86 has one end connected to the suction passage through which the working fluid is drawn into the expansion chamber of the expansion mechanism 3, and another end connected to the internal space 84*h* of the heat insulating structure 30F.

In a refrigeration cycle using carbon dioxide as the working fluid (refrigerant), for example, the pressure in the internal space 24 of the closed casing 1 reaches 10 MPa. Thus, if a housing having merely a hollow is used in the heat insulating structure of the present invention, the housing may be damaged due to the pressure difference. In contrast, the pressure of the working fluid that is not yet expanded at the expansion mechanism 3 is almost equal to the pressure of the working fluid filling the internal space 24 of the closed casing 1. Therefore, when the internal space 84*h* of the heat insulating structure 30F is filled with the working fluid that is not yet expanded at the expansion mechanism 3 as in the present embodiment, there is no possibility for the housing 84 to be damaged due to the pressure difference.

As shown in FIG. 22, a space 45*h* is formed in the upper bearing member 45 of the expansion mechanism 3 as a part of the suction passage through which the working fluid is drawn into the expansion chamber. The suction pipe 52 is connected to the space 45*h*. The branch passage 86 is provided in a portion in which the space 45*h* is formed. The branch passage 86 is formed by connecting vertically a through hole provided in the housing 84 to a through hole provided in the upper bearing member 45. When configured in this manner, no additional pipe is needed, which is advantageous in saving space. A part of the working fluid having flowed into the space 45*h* of the upper bearing member 45 is supplied to the internal space 84*h* of the heat insulating structure 30F via the branch passage 86. Furthermore, the working fluid flows through the suction passage 54 penetrating through the second cylinder 44, the intermediate plate 43, and the first cylinder 42, and passes through an interior of the lower bearing member 41 to flow into the expansion chamber.

The location at which the suction passage for the working fluid is branched off is not limited in the interior of the upper bearing member 45. For example, it is possible for the suction pipe 52 to be branched off into two pipes outside of the closed casing 1 so that one of the pipes is connected to the internal space 84*h* of the heat insulating structure 30F and the other pipe is connected to the expansion mechanism 3.

(Embodiment 7)

Figure 23:
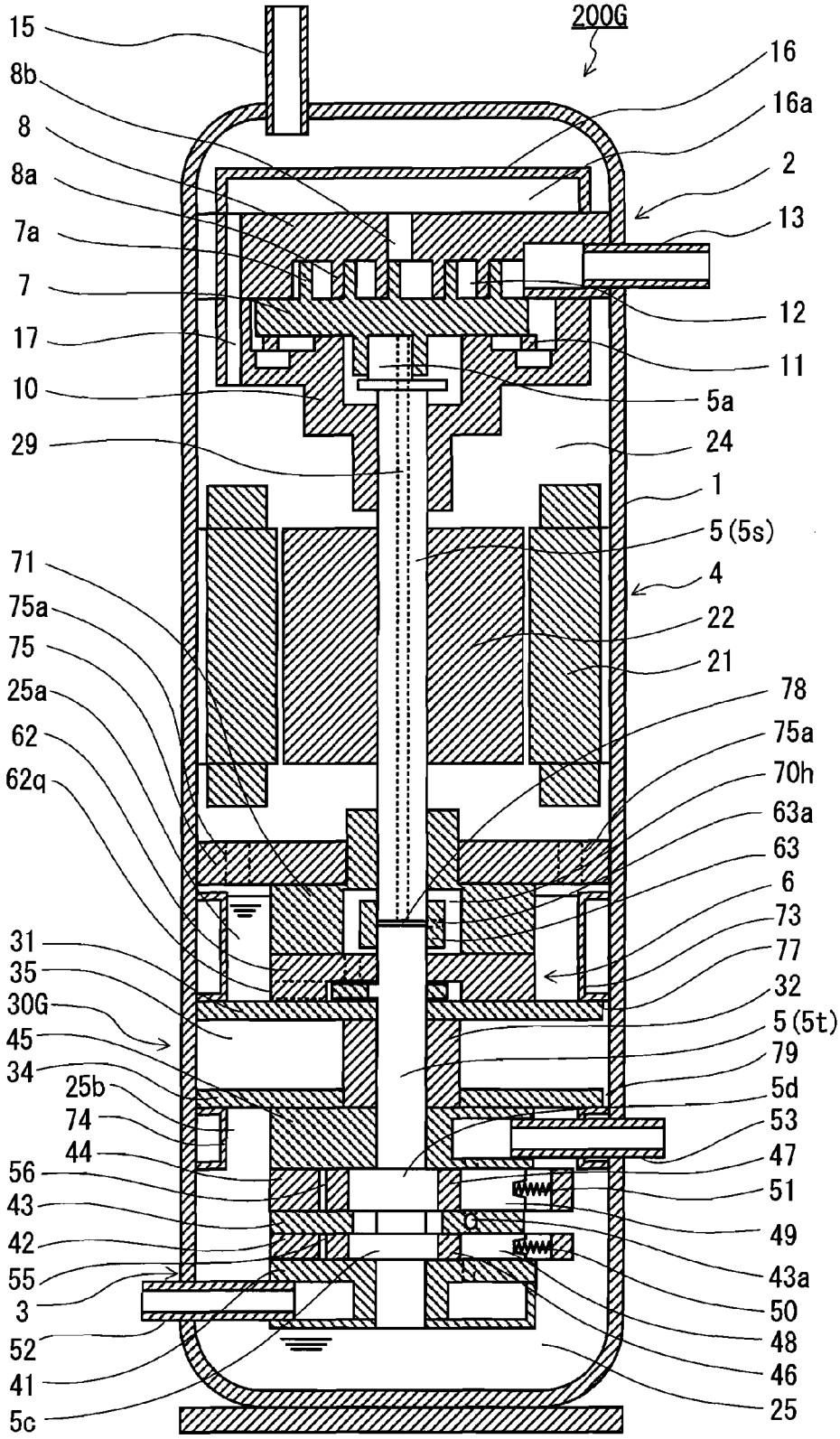
FIG. 23 is a vertical cross-sectional view of an expander-integrated compressor according to Embodiment 7.

FIG. 23 is a vertical cross-sectional view of an expander-integrated compressor according to Embodiment 7. The expander-integrated compressor 200G of the present embodiment is a combination of the expander-integrated compressor of the Embodiment 2 and that of the Embodiment 3.

As shown in FIG. 23, the heat insulating structure 30G of the expander-integrated compressor 200G includes the upper partition plate 31, the lower partition plate 34, the spacer 32, the upper, side heat-insulating body 73, and the lower, side heat-insulating body 74. The space 35 filled with the oil is formed between the upper partition plate 31 and the lower partition plate 34. The upper, side heat-insulating body 73 covers the inner surface of the closed casing 1 from a position corresponding to an upper face of the upper partition plate 31 to a predetermined position above the upper partition plate 31. The lower, side heat-insulating body 74 covers the inner surface of the closed casing 1 from a position corresponding to the lower face of the lower partition plate 34 to a predetermined position under the lower partition plate 34. The side heat-insulating bodies 73 and 74 can suppress the heat transfer from the upper tank 25*a* to the lower tank 25*b* via the closed casing 1. The upper, side heat-insulating body 73 can be the upper heat-insulating cover 73 forming, between itself and the inner surface of the closed casing 1, the cylindrical space filled with the oil held in the upper tank 25*a*. Likewise, the lower, side heat-insulating body 74 can be the lower heat-insulating cover 74 forming, between itself and the inner surface of the closed casing 1, the cylindrical space filled with the oil held in the lower tank 25*b*.

(Embodiment 8)

Figure 24:
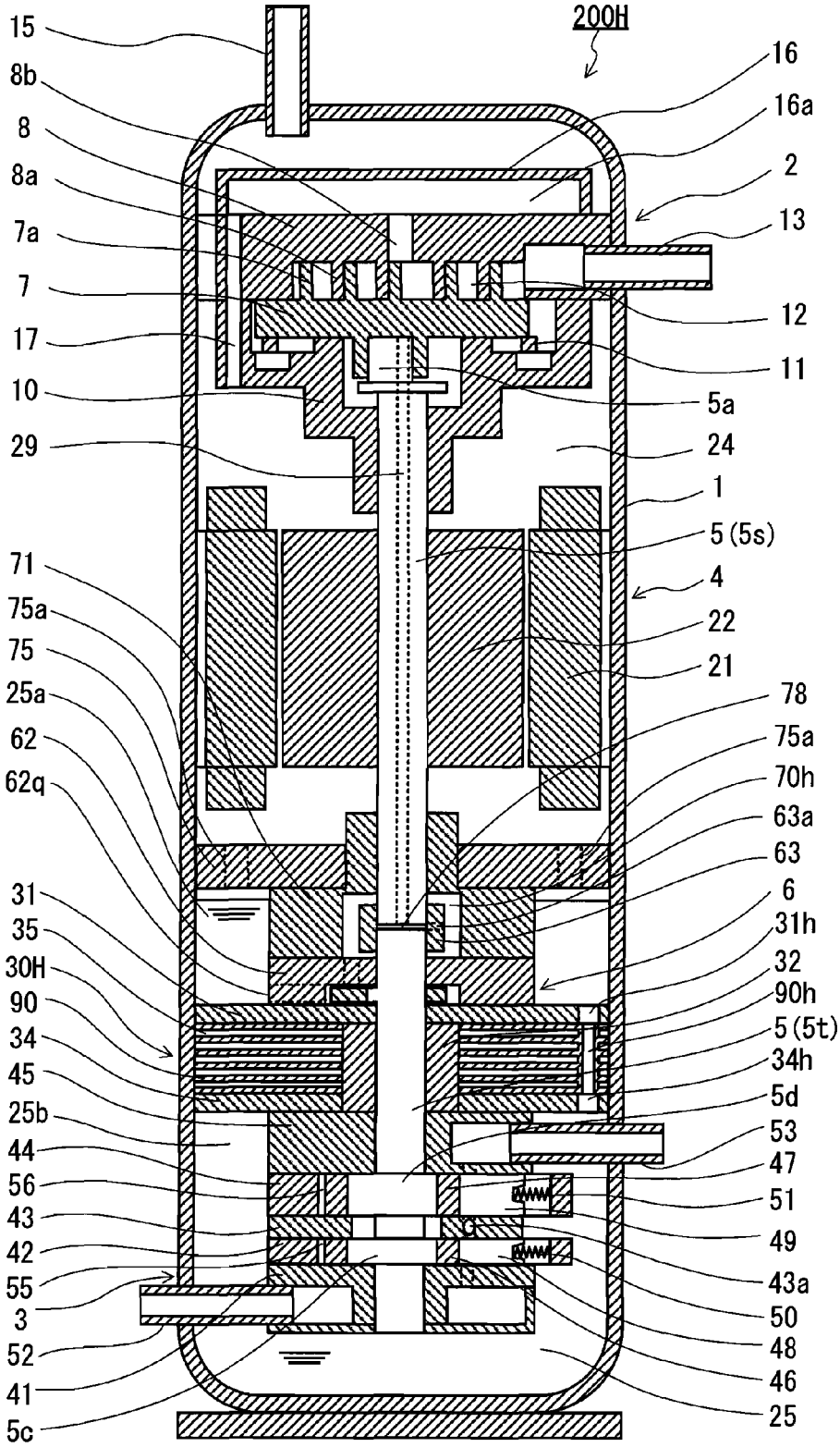
FIG. 24 is a vertical cross-sectional view of an expander-integrated compressor according to Embodiment 8.

FIG. 24 is a vertical cross-sectional view of an expander-integrated compressor according to Embodiment 8. The expander-integrated compressor 200H of the present embodiment is a modified example of the expander-integrated compressor 200C of the Embodiment 3, and a difference between them resides in the heat insulating structure provided between the oil pump 6 and the expansion mechanism 3.

As shown in FIG. 24, the heat insulating structure 30H of the expander-integrated compressor 200H includes the upper partition plate 31, the spacer 32, and the lower partition plate 34. Their configurations are as described in the Embodiment 3. The heat insulating structure 30H includes further a flow suppressing member 90 that is disposed in the internal space 35 of the heat insulating structure 30H, and that suppresses the flow of the oil (heat insulating fluid) filling the internal space 35. Suppressing the oil flow (particularly, the flow in the axial direction) in the internal space 35 of the heat insulating structure 30H forms stable thermal stratification. Thereby, heat insulation effect should be enhanced.

Figure 25:
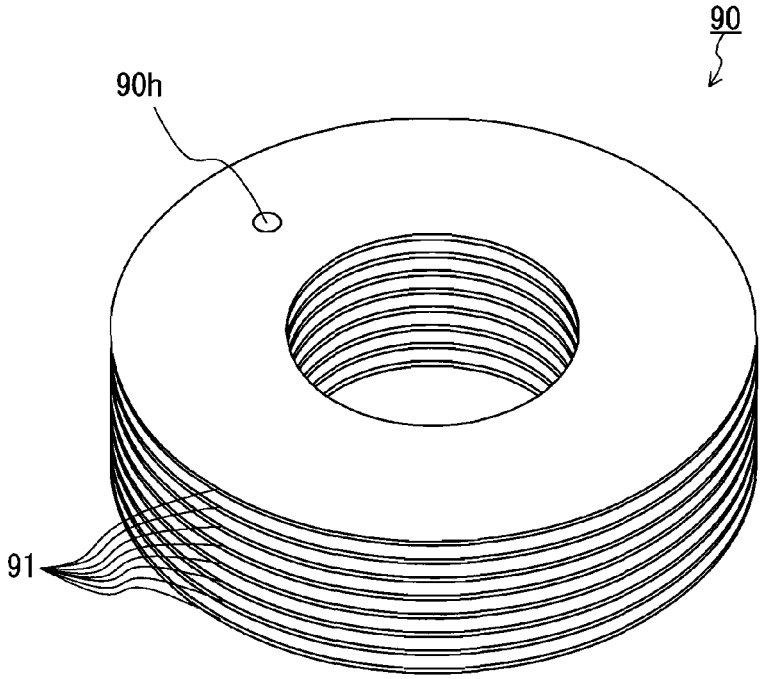
FIG. 25 is a perspective view of a flow suppressing member.

As shown in the perspective view of FIG. 25, the flow suppressing member 90 includes a plurality of disks 91 arranged concentrically at a constant interval in a height direction. The oil fills spaces each formed by the adjacent two disks 91 and 91. Each of the disks 91 has, at a center thereof, a through hole into which the spacer 32 is fitted. Furthermore, each of the disks 91 has a passage 90*h* that penetrates through each of the disks 91 in a thickness direction. The passage 90*h* allows the oil to flow between the upper tank 25*a* and the lower tank 25*b*. As shown in FIG. 24, the passage 90*h* is isolated from the spaces each formed between the adjacent two disks 91 and 91, that is, the internal space 35 of the heat insulating structure 30H. The location of the flow suppressing member 90 is determined in the internal space 35 so that one end of the passage 90*h* is connected to the through hole 31*h* of the upper partition plate 31 and another end of the passage 90*h* is connected to the through hole 34*h* of the lower partition plate 34.

Figure 26:
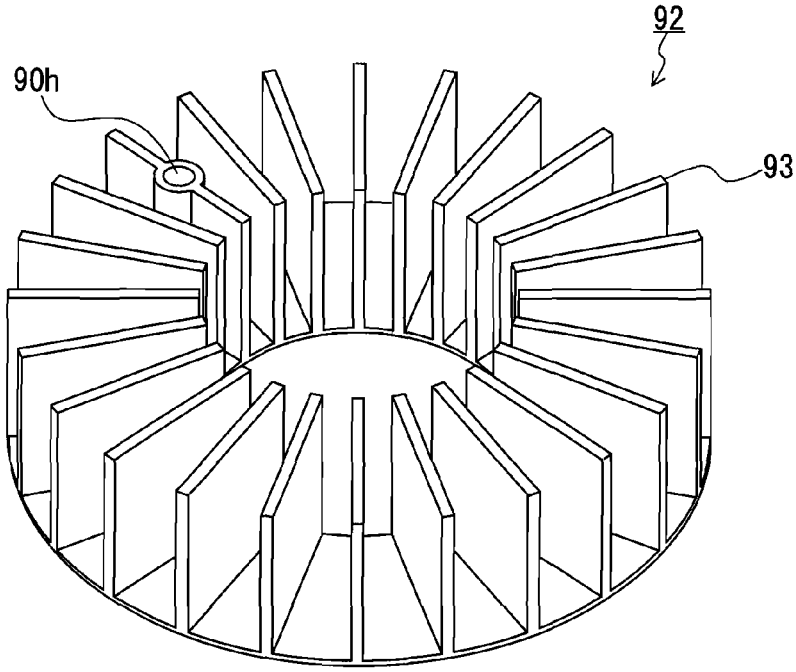
FIG. 26 is a perspective view showing another example of the flow suppressing member.
Figure 27:
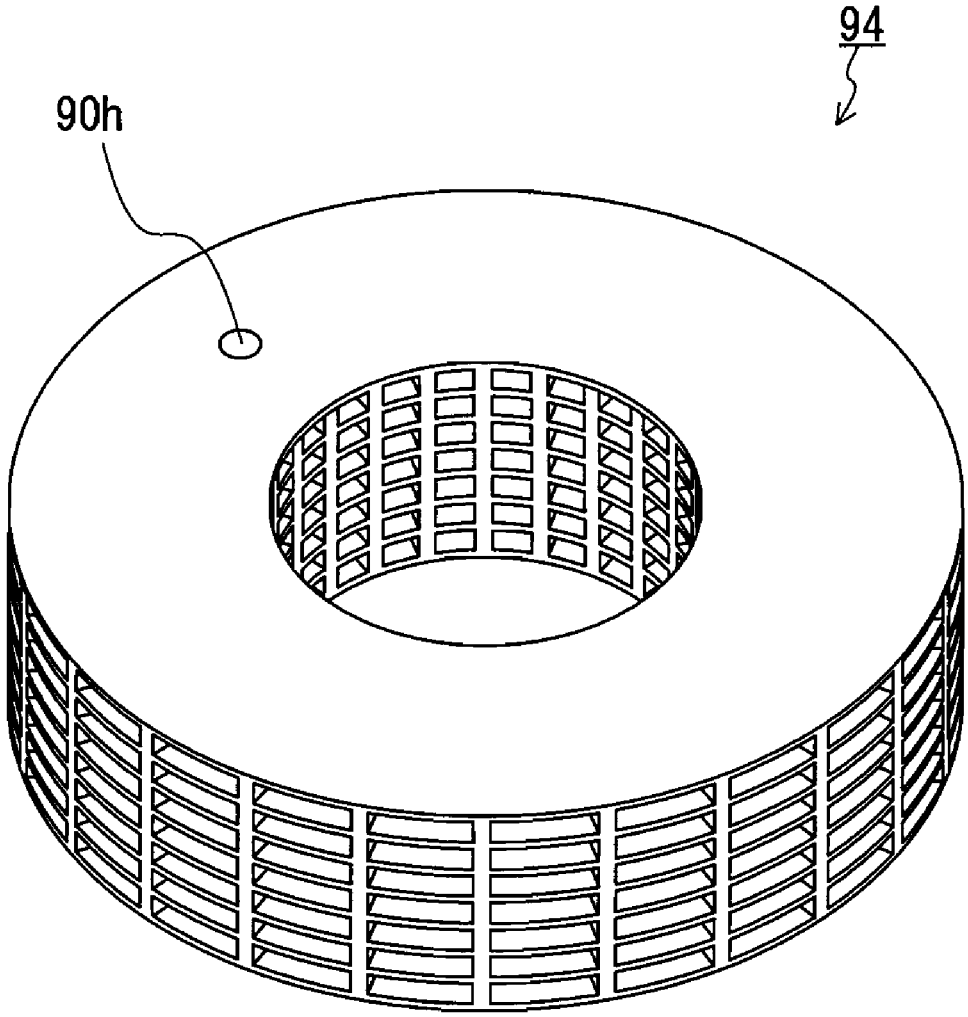
FIG. 27 is a perspective view showing still another example of the flow suppressing member.

The material of the flow suppressing member 90 is not particularly limited. Metal, resin, and ceramics can be used, for example. The shape of the flow suppressing member 90 is not particularly limited as long as it is effective in suppressing the oil flow in the internal space 35. For example, a flow suppressing member 92 shown in FIG. 26 includes a plurality of partition plates 93 partitioning the internal space 35 of the heat insulating structure 30H into a plurality of sections along the circumferential direction of the shaft 5. Thereby, spaces that can be filled with the oil are formed radially. The flow suppressing member 92 mainly suppresses the oil from flowing along the circumferential direction of the shaft 5. In addition, a flow suppressing member 94 shown in FIG. 27 is a combination of the aforementioned two flow suppressing members 90 and 92. In the flow suppressing member 94, the spaces that can be filled with the oil are separated in both of the height direction and the circumferential direction.

This specification has described some embodiments above, and two or more of the disclosed embodiments may be used in combination without departing from the scope of the present invention. For example, the second spacer described in the Embodiment 1 and the flow suppressing member described in the Embodiment 8 may be applied to the other embodiments, which is an idea that can be come up with easily.

Industrial Applicability

Figure 28:
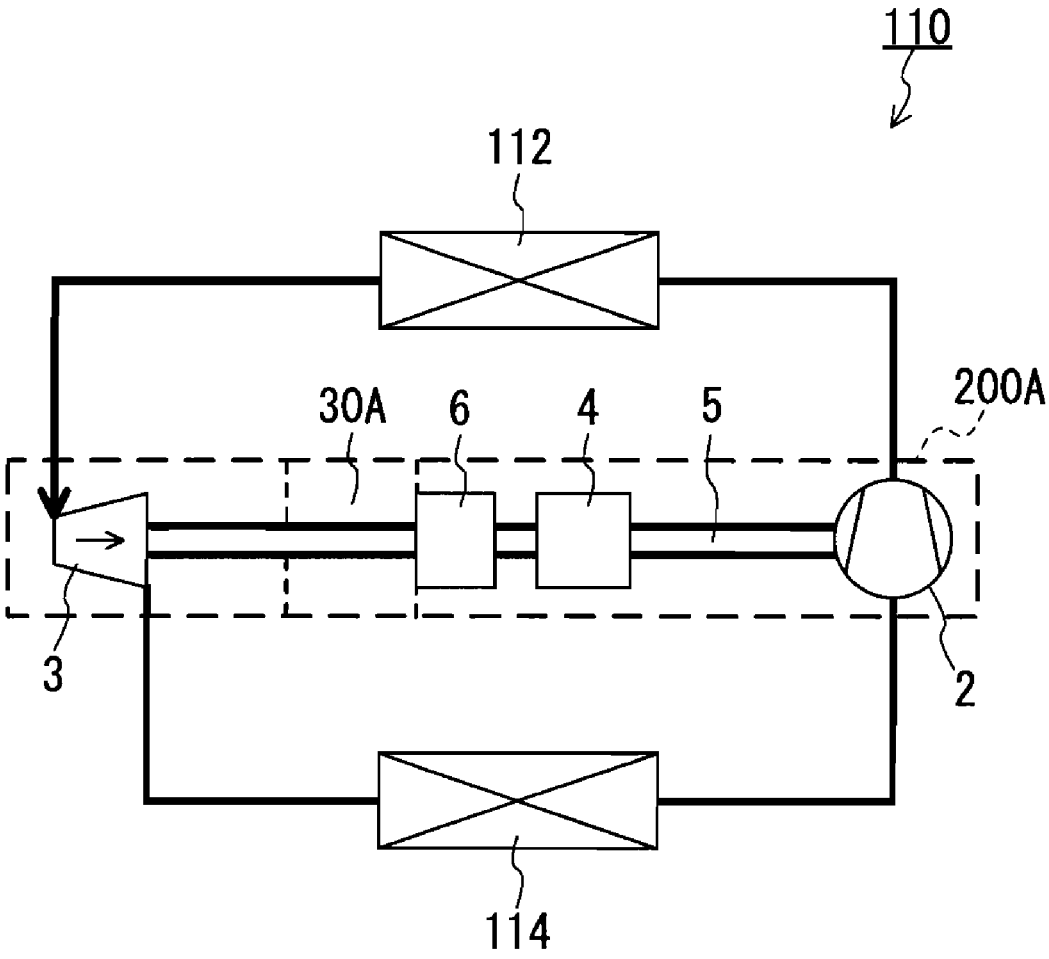
FIG. 28 is a configuration diagram of a heat pump using the expander-integrated compressor.

The expander-integrated compressor of the present invention suitably may be employed, for example, in heat pumps for air conditioners, water heaters, driers, and refrigerator-freezers. As shown in FIG. 28, a heat pump 110 includes the expander-integrated compressor 200A, a radiator 112 for cooling the refrigerant compressed by the compression mechanism 2, and an evaporator 114 for evaporating the refrigerant expanded by the expansion mechanism 3. The compression mechanism 2, the radiator 112, the expansion mechanism 3, and the evaporator 114 are connected with pipes to form a refrigerant circuit. The expander-integrated compressor 200A may be replaced with the expander-integrated compressor of another embodiment.

For example, when the heat pump 110 is employed in an air conditioner, it is possible to prevent a decrease in heating capacity caused by a decreased discharge temperature of the compression mechanism 2 during heating operation, and a decrease in cooling capacity caused by an increased discharge temperature of the expansion mechanism 3 during cooling operation, by suppressing the heat transfer from the compression mechanism 2 to the expansion mechanism 3. As a result, the coefficient of performance of the air conditioner is enhanced.

The invention claimed is:

1. An expander-integrated compressor comprising:

a closed casing having a bottom portion utilized as an oil reservoir, and an internal space to be filled with a working fluid compressed to a high pressure;

a compression mechanism for compressing the working fluid and discharging the working fluid to the internal space of the closed casing, the compression mechanism being disposed at an upper part of the closed casing;

an expansion mechanism for recovering mechanical power from the expanding working fluid, the expansion mechanism being disposed at a lower part of the closed casing in such a manner that a space surrounding the expansion mechanism is filled with an oil held in the oil reservoir;

a shaft coupling the compression mechanism and the expansion mechanism so as to transfer the mechanical power recovered by the expansion mechanism to the compression mechanism;

an oil pump for drawing the oil held in the oil reservoir via an oil suction port and supplying the oil to the compression mechanism, the oil pump being disposed between the compression mechanism and the expansion mechanism in an axial direction of the shaft; and a heat insulating structure for suppressing heat transfer from an upper tank, in which the oil suction port is located, to a lower tank, in which the expansion mechanism is located, by limiting a flow of the oil between the upper tank and the lower tank, the heat insulating structure being disposed between the oil pump and the expansion mechanism in the axial direction of the shaft.

2. The expander-integrated compressor according to claim 1, wherein:

the expansion mechanism is a rotary-type expansion mechanism including a cylinder, a piston disposed in the cylinder in such a manner that the piston is fitted into an eccentric portion of the shaft, and a closing member that closes the cylinder to form an expansion chamber together with the cylinder and the piston, and the heat insulating structure is constituted by a member separate from the closing member.

3. The expander-integrated compressor according to claim 1, wherein:

the heat insulating structure includes a partition plate separating the upper tank from the lower tank; and the oil is allowed to flow between the upper tank and the lower tank via a clearance formed between an inner surface of the closed casing and an outer circumferential surface of the partition plate.

4. The expander-integrated compressor according to claim 1, wherein:

the heat insulating structure includes a partition plate separating the upper tank from the lower tank; and the partition plate has a through hole through which the oil is allowed to flow between the upper tank and the lower tank.

5. The expander-integrated compressor according to claim 1, wherein the heat insulating structure includes: a partition plate separating the upper tank from the lower tank; and a spacer that is disposed between the partition plate and the expansion mechanism and forms, between the partition plate and the expansion mechanism, a space filled with the oil held in the lower tank.

6. The expander-integrated compressor according to claim 5, wherein the spacer includes a cover covering the shaft, or a bearing supporting the shaft.

7. The expander-integrated compressor according to claim 6, wherein the spacer functioning as the cover or the bearing has a lower thermal conductivity than that of the partition plate.

8. The expander-integrated compressor according to claim 5, wherein the heat insulating structure further includes: an upper, side heat-insulating body covering an inner surface of the closed casing from a position corresponding to an upper face of the partition plate to a predetermined position above the partition plate; and/or a lower, side heat-insulating body covering the inner surface of the closed casing from a position corresponding to a lower face of the partition plate to a predetermined position under the partition plate.

9. The expander-integrated compressor according to claim 8, wherein:

the upper, side heat-insulating body is an upper heat-insulating cover forming, between itself and the inner surface of the closed casing, a space with a cylindrical shape or an arc shape filled with the oil held in the upper tank; and the lower, side heat-insulating body is a lower heat-insulating cover forming, between itself and the inner surface of the closed casing, a space with a cylindrical shape or an arc shape filled with the oil held in the lower tank.

10. The expander-integrated compressor according to claim 1, wherein the heat insulating structure includes: an upper partition plate disposed on a side of the oil pump; a lower partition plate disposed on a side of the expansion mechanism; and a spacer that is disposed between the upper partition plate and the lower partition plate and forms, between the upper partition plate and the lower partition plate, an internal space that can be filled with a heat insulating fluid.

11. The expander-integrated compressor according to claim 10, wherein the spacer includes a cover covering the shaft, or a bearing supporting the shaft.

12. The expander-integrated compressor according to claim 11, wherein the spacer functioning as the cover or the bearing has a lower thermal conductivity than those of the partition plates.

13. The expander-integrated compressor according to claim 10, wherein the spacer forms, between the lower partition plate and the expansion mechanism, a space filled with the oil.

14. The expander-integrated compressor according to claim 10, wherein the internal space of the heat insulating structure is filled with, as the heat insulating fluid, the oil held in the bottom portion of the closed casing.

15. The expander-integrated compressor according to claim 14, wherein:

the upper partition plate and/or the lower partition plate has a passage leading to the internal space of the heat insulating structure; and the oil fills the internal space of the heat insulating structure via the passage.

16. The expander-integrated compressor according to claim 15, wherein the oil is allowed to flow between the upper tank and the lower tank via the internal space of the heat insulating structure.

17. The expander-integrated compressor according to claim 10, wherein the oil is allowed to flow between the upper tank and the lower tank via a clearance formed between an inner surface of the closed casing and an outer circumferential surface of the upper partition plate, and/or via a clearance formed between the inner surface of the closed casing and an outer circumferential surface of the lower partition plate.

18. The expander-integrated compressor according to claim 10, wherein the heat insulating structure further includes a pipe connecting the upper tank and the lower tank so as to allow the oil to flow between the upper tank and the lower tank.

19. The expander-integrated compressor according to claim 10, wherein:

the internal space of the heat insulating structure is a space isolated from the internal space of the closed casing; and the heat insulating structure further includes a branch passage having one end connected to a suction passage through which the working fluid is drawn into an expansion chamber of the expansion mechanism and another end connected to the internal space of the heat insulating structure so as to supply, as the heat insulating fluid, a part of the working fluid to be drawn into the expansion mechanism to the internal space of the heat insulating structure.

20. The expander-integrated compressor according to claim 10, wherein the heat insulating structure further includes: an upper, side heat-insulating body covering an inner surface of the closed casing from a position corresponding to an upper face of the upper partition plate to a predetermined position above the upper partition plate; and/or a lower, side heat-insulating body covering the inner surface of the closed casing from a position corresponding to an lower face of the lower partition plate to a predetermined position under the lower partition plate.

21. The expander-integrated compressor according to claim 20, wherein:

the upper, side heat-insulating body is an upper heat-insulating cover forming, between itself and the inner surface of the closed casing, a cylindrical space filled with the oil held in the upper tank; and the lower, side heat-insulating body is a lower heat-insulating cover forming, between itself and the inner surface of the closed casing, a cylindrical space filled with the oil held in the lower tank.

22. The expander-integrated compressor according to claim 10, wherein the heat insulating structure further includes a flow suppressing member that is disposed in the internal space of the heat insulating structure, and that suppresses a flow of the heat insulating fluid filling the internal space.

23. The expander-integrated compressor according to claim 1, wherein:

an oil supply passage leading to a sliding part of the compression mechanism is formed in the shaft and extends in the axial direction; and the oil discharged from the oil pump is fed into the oil supply passage.

24. The expander-integrated compressor according to claim 23, further comprising a relay member for accommodating temporarily the oil discharged from the oil pump, wherein an inlet of the oil supply passage faces an internal space of the relay member so that the oil is fed into the oil supply passage.

25. The expander-integrated compressor according to claim 24, wherein:

the shaft includes a first shaft on a side of the compression mechanism, the first shaft having the oil supply passage formed therein, and a second shaft on a side of the expansion mechanism, the second shaft being coupled to the first shaft; and the first shaft and the second shaft are coupled to each other in the internal space of the relay member.

26. The expander-integrated compressor according to claim 25, further comprising a coupler disposed in the internal space of the relay member so that the first shaft and the second shaft are coupled to each other in the relay member.

27. The expander-integrated compressor according to claim 1, wherein:

the shaft includes a first shaft on a side of the compression mechanism and a second shaft on a side of the expansion mechanism, the second shaft being coupled to the first shaft;

an oil supply passage leading to a sliding part of the compression mechanism is formed at least in the first shaft and extends in the axial direction; and the oil pump and the oil supply passage are connected to each other via a relay passage that guides the oil discharged from the oil pump to the oil supply passage.

28. The expander-integrated compressor according to claim 27, wherein:

the relay passage includes a cylindrical space surrounding the shaft in a circumferential direction; and an inlet of the oil supply passage is formed in an outer circumferential surface of the shaft so as to face the cylindrical space.

29. The expander-integrated compressor according to claim 28, wherein the inlet of the oil supply passage, a coupling portion of the first shaft and the second shaft, and the oil pump are arranged in this order from the compression mechanism side.

30. The expander-integrated compressor according to claim 28, wherein a coupling portion of the first shaft and the second shaft, the inlet of the oil supply passage, and the oil pump are arranged in this order from the compression mechanism side.

31. The expander-integrated compressor according to claim 28, wherein the oil pump, the inlet of the oil supply passage, and a coupling portion of the first shaft and the second shaft are arranged in this order from the compression mechanism side.

32. The expander-integrated compressor according to claim 28, wherein the oil pump, a coupling portion of the first shaft and the second shaft, and the inlet of the oil supply passage are arranged in this order from the compression mechanism side.

33. The expander-integrated compressor according to claim 28, wherein the inlet of the oil supply passage, the oil pump, and a coupling portion of the first shaft and the second shaft are arranged in this order from the compression mechanism side.

34. The expander-integrated compressor according to claim 28, wherein a coupling portion of the first shaft and the second shaft, the oil pump, and the inlet of the oil supply passage are arranged in this order from the compression mechanism side.

* * * * *

UNITED STATES PATENT AND TRADEMARK OFFICE

CERTIFICATE OF CORRECTION

PATENT NO. : 8,177,525 B2
APPLICATION NO. : 12/522762
DATED : May 15, 2012
INVENTOR(S) : Takahashi et al.

It is certified that error appears in the above-identified patent and that said Letters Patent is hereby corrected as shown below:

Column 26, line 39 (Claim 29): "in this order from the compression mechanism side" should read --in this order in the axial direction of the shaft from the compression mechanism to the expansion mechanism--.

Column 26, line 44 (Claim 30): "in this order from the compression mechanism side" should read --in this order in the axial direction of the shaft from the compression mechanism to the expansion mechanism--.

Column 26, line 49 (Claim 31): "in this order from the compression mechanism side" should read --in this order in the axial direction of the shaft from the compression mechanism to the expansion mechanism--.

Column 26, line 54 (Claim 32): "in this order from the compression mechanism side" should read --in this order in the axial direction of the shaft from the compression mechanism to the expansion mechanism--.

Column 26, line 59 (Claim 33): "in this order from the compression mechanism side" should read --in this order in the axial direction of the shaft from the compression mechanism to the expansion mechanism--.

Column 26, line 64 (Claim 34): "in this order from the compression mechanism side" should read --in this order in the axial direction of the shaft from the compression mechanism to the expansion mechanism--.

Signed and Sealed this
Fifth Day of February, 2013

Teresa Stanek Rea
*Acting Director of the United States Patent and Trademark Office*